US008048833B2

(12) United States Patent
Habeeb et al.

(10) Patent No.: US 8,048,833 B2
(45) **Date of Patent: *Nov. 1, 2011**

(54) CATALYTIC ANTIOXIDANTS

(75) Inventors: Jacob J. Habeeb, Westfield, NJ (US); Michael E. Landis, Mullica Hill, NJ (US); Abhimanyu O. Patil, Westfield, NJ (US); Brandon T Weldon, Cherry Hill, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 736 days.

This patent is subject to a terminal disclaimer.

(21) Appl. No.: 11/893,809

(22) Filed: Aug. 17, 2007

(65) Prior Publication Data

US 2009/0048130 A1 Feb. 19, 2009

(51) Int. Cl.

| | |
|---|---|
| ***C10M 159/18*** | (2006.01) |
| ***C10M 125/04*** | (2006.01) |
| ***C09K 15/00*** | (2006.01) |
| ***C07C 211/00*** | (2006.01) |

(52) U.S. Cl. ..... 508/362; 508/366; 508/585; 564/433; 564/434

(58) Field of Classification Search ..... 508/362, 508/366, 585; 564/433, 434

See application file for complete search history.

(56) References Cited

U.S. PATENT DOCUMENTS

| | | | | |
|---|---|---|---|---|
| 2,645,613 | A | 7/1953 | Adelson et al. | |
| 3,018,248 | A | 1/1962 | Foehr | |
| 3,764,534 | A * | 10/1973 | Blejean et al. | 508/568 |
| 3,779,920 | A | 12/1973 | Devries | |
| 4,066,561 | A | 1/1978 | Nnadi | |
| 4,871,875 | A * | 10/1989 | Nagata et al. | 564/402 |
| 5,376,154 | A | 12/1994 | Daly et al. | |
| 5,824,627 | A * | 10/1998 | McConnachie et al. | 508/363 |
| 6,455,477 | B1 * | 9/2002 | L'Heureux | 508/287 |
| 2003/0196372 | A1 | 10/2003 | Wolf | |
| 2006/0149089 | A1 | 7/2006 | Malfroy-Camine et al. | |
| 2006/0258549 | A1 | 11/2006 | Habeeb et al. | |
| 2007/0265178 | A1 * | 11/2007 | Patil et al. | 508/557 |
| 2008/0245336 | A1 * | 10/2008 | Patil et al. | 123/196 R |
| 2008/0248984 | A1 * | 10/2008 | Patil et al. | 508/557 |
| 2008/0248985 | A1 * | 10/2008 | Patil et al. | 508/557 |

FOREIGN PATENT DOCUMENTS

| | | | |
|---|---|---|---|
| EP | 1 702 973 | A1 | 9/2006 |
| WO | WO 03/006420 | A1 | 1/2003 |
| WO | WO 2008/039345 | A2 | 4/2008 |

OTHER PUBLICATIONS

Joseph A. Bonadies et al., Structurally Diverse Manganese (III) Schiff Base COmplexes: Chains, Dimers, and Cages, Sep. 2, 1988, Inorganic Chemistry, 28, 2037-2044.*

Gopal L. Tembe, et al., "Oxidation of alkanes by tert-butyl hydroperoxide catalyzed by polynuclear manganese Schiff base complexes", *Journal of Molecular Catalysis A: Chemical* 121 (1997), pp. 17-23.

M. Tyler Caudle, et al., "Mechanism for the Homolytic Cleavage of Alkyl Hydroperoxides by the Manganese(III) Dimer $Mn^{III}_2$(2-OHsalpn)$_2$ ", *Inorg. Chem.*, 1996, 35, pp. 3577-3584.

K. Srinivasan, et al., "Dual Pathways for Manganese Catalysis of Olefin Oxidation with Alkyl Hydroperoxides", *Journal of Molecular Catalysis*, 36 (1986), pp. 297-317.

* cited by examiner

*Primary Examiner* — Glenn Caldarola
*Assistant Examiner* — Vishal Vasisth
(74) *Attorney, Agent, or Firm* — Liza Montalvo

(57) ABSTRACT

The present invention is directed to lubricating oils exhibiting improved resistance to oxidation and deposit/sludge formation comprising a lubricant base oil and catalytic antioxidants comprising an effective amount of a) one or more polymetal organometallic compound; and, b) effective amounts of one or more substituted N,N'-diaryl-o-phenylenediamine compounds or c) one or more hindered phenol compounds or both, to a method for improving the antioxidancy and the resistance to deposit/sludge formation of formulated lubricating oil compositions by the addition thereto of an effective amount of the aforementioned catalytic antioxidants, and to an additive concentrate containing the aforementioned catalytic antioxidants.

30 Claims, No Drawings

CATALYTIC ANTIOXIDANTS

FIELD OF THE INVENTION

The present invention relates to lubricating oil compositions comprising a lubricant base oil and additives which neutralize the prooxidants that cause the oxidative decomposition of the lubricating oil composition and prevent deposit/sludge formation.

BACKGROUND OF THE INVENTION

Oxidation causes buildup of particulate matter in lubricating oils. This buildup thickens the lubricating oil and causes deposits in engine parts. When the level gets too high, the increase in viscosity results in poor lubrication and an inefficient operation of the engine system. Such inefficiencies result in loss of fuel economy and increased exhaust emissions.

Currently, lubricating oil formulations are rendered resistant to oxidative degradation by the addition to the lubricating oil formulations of free radical scavenger antioxidants such as sterically hindered phenols, hindered amines and mixtures thereof and hydroperoxide decomposers such as zinc dialkyldithiophosphate.

Most of such antioxidants as are presently used are consumed by the oxidation promoters in the oil (the prooxidants) on a stoichiometric basis. Antioxidants can be added to lubricating oil formulations only in limited quantities and consequently even if and when the maximum practical amount is added they are quickly consumed and disappear, with the undefended oil rapidly oxidizing with their disappearance.

Other antioxidants such as copper acetylacetonates, while consuming the prooxidants on a more than stoichiometric basis are still themselves used-up at a rate of less than about 10:1 and therefore, while superior to the phenolic and aminic antioxidants are still not sufficiently long lived or suitable for the next generation of extended drain lube oils or sealed for life/filled for life lubricant environments.

Prooxidants are continuously generated in the lubricant during routine use or added/introduced into the oil by blow-by gases, or exhaust gas recirculation as during the operation of internal combustion engines.

U.S. Pat. No. 4,867,890 teaches oil soluble organo copper compounds as antioxidants. U.S. Pat. No. 5,650,381 teaches a lubricating oil composition which contains from about 100 to 400 ppm of molybdenum from a molybdenum compound which is substantially free of active sulfur and about 750 to 5,000 ppm of a secondary diaryl amine, which provide improved oxidation control and friction modifier performance. U.S. Pat. No. 6,121,211 teaches a lubricating oil composition comprising a base oil of lubricating viscosity and at least one thiocarbamate containing a divalent metal and a sludge preventing and seal protecting amount of at least one aldehyde or epoxide or mixture thereof. JP 53024957 teaches the liquid phase oxidation of cyclohexane into cyclohexanol by oxidizing the cyclohexane with an oxygen containing gas in the liquid phase in the presence of metal salts selected from the group consisting of Cr, V and W of an organic acid or a chelate compound as a catalyst.

U.S. Pat. No. 4,766,228 teaches a metal dihydrocarbyldithiophosphoryl dithiophosphate material containing a metal selected from zinc, cadmium, lead and antimony or an oxygen and/or sulfur-containing molybdenum complex useful as a lubricant additive (see also U.S. Pat. No. 4,882,446). U.S. Pat. No. 5,439,604 teaches compositions containing metal salts of polyalkenyl substituted monounsaturated mono- or dicarboxylic acids which may be used as a compatibilizing material for mixtures of dispersants, detergents, anti-wear and antioxidant materials. U.S. Pat. No. 3,707,498 teaches antioxidant additives comprising a mixture of a metal dialkyldithiocarbamate and a tertiaryalkyl primary amine, where the metal is from Group IIb, IVa and Va.

U.S. Pat. No. 3,351,647 teaches a composition useful as an oil additive that functions as an antioxidant and antiwear agent having the general formula:

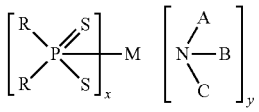

wherein R is a substantially hydrocarbon radical; M is a metal selected from the group consisting of zinc, calcium, copper, nickel, cobalt, chromium, lead, and cadmium; A, B and C are radicals selected from the class consisting of hydrogen and substantially hydrocarbon radicals; x is the valence of M; y is from about 0.5 to about 6. U.S. Pat. No. 4,427,560 teaches a formulation containing among other additives an oxidation inhibitor. The oxidation inhibitors comprising sulfur bridge, bis hindered phenols effectively limit or prevent the attack of oxidants on copper/lead metal and preferably comprise bis (dithiobenzyl) metal derivatives having the formula:

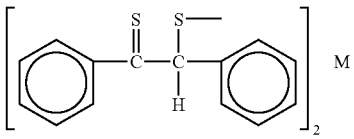

U.S. Pat. No. 3,764,534 teaches a composition comprising a lubricating oil and at least one thioorganometallic complex of the formula:

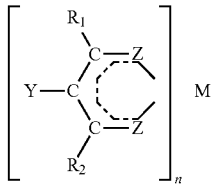

in which M is selected from the transition metals and zinc, cadmium, tin, lead, antimony and bismuth; n is the oxidation degree of M, $R_1$ and $R_2$ are each a monovalent hydrocarbon radical having one to 20 carbon atoms and 0 to 3 heteroatoms selected from the group consisting of halogen, oxygen, sulfur and nitrogen; Y is selected from the hydrogen atom and the radicals R', R'O, R'S and R'CO in which R' is a hydrocarbon radical of 1 to 20 carbon atoms; Y and $R_1$ or $R_2$ may form a divalent hydrocarbon radical containing 1 to 20 carbon atoms and 0-3 heteroatoms selected form oxygen, sulfur and nitrogen; and each atom Z is oxygen or sulfur, at least one of the 2n atoms Z being sulfur. It is recited that these materials exhibit high antioxidancy activity even at high temperature. They can be used with base oils of petroleum origin as well as with synthetic base oils. See also GB 1,322,699.

GB 1,358,961 teaches that 9,10-dihydroanthracene acts synergistically with certain metal β-diketone complexes to provide antioxidancy. The metal β-diketone complexes are of the formula $$M(\text{-}O\text{—}CR_1{=}CR_2\text{—}CR_3{=}O)_n$$

wherein M is a metal, n is 2 or 3, $R_2$ is hydrogen or an alkyl group having 1 to 20 carbon atoms and $R_1$ and $R_3$ are alkyl, aryl or alkoxy groups having 1-10 carbons. U.S. Pat. No. 4,849,123 teaches drivetrain fluids comprising oil soluble transition metal compounds which address low temperature thickening of automatic transmission fluids (ATFs) and high temperature thickening or gear oils. When used in combination with zinc dialkyl dithiophosphates, the quantity of metal compound in the ATFs or gear lubricants is important to obtaining the combination of antioxidant and antiwear properties needed for the extended life of the fluids.

U.S. Pat. No. 4,705,641 teaches the combination of copper and molybdenum salts as being an effective antioxidant and antiwear additive for hydrocarbons such as lube oils. The copper salt preferably is selected from the group of carboxylates consisting of oleates, stearates, naphthenates and mixtures thereof and the molybdenum salt preferably is selected from the group of carboxylates consisting of naphthenates, oleates, stearates and mixtures thereof.

U.S. Pat. No. 4,122,033 discloses an oxidation inhibitor and a method for using the oxidation inhibitor for hydrocarbon materials, particularly lube oils. One or more transition metal containing compounds can be utilized in combination with one or more peroxide decomposer compounds selected from aliphatic amines, alkyl selenides, alkyl phosphines and phosphates wherein the aliphatic and alkyl portions of said compound each contain from about 1 to about 50 carbon atoms as oxidation inhibitors in organic compositions subject to auto-oxidation. Among the transition metal compounds useful according to the patent are the salts of scandium, titanium, vanadium, chromium, manganese, iron, cobalt, nickel, copper, yttrium, zirconium, niobium, molybdenum, tellurium, ruthenium, rhodium, palladium, and silver, to mention a few.

U.S. Pat. No. 5,631,212 teaches an engine oil of improved wear resistance and antioxidancy comprising base oil, an oil soluble copper salt, an oil soluble molybdenum salt, a Group II metal salicylate and a borated polyalkenyl succinimide. Molybdenum salts are the oil soluble salts of synthetic or natural organic acids, preferably $C_4$ to $C_{30}$ saturated and unsaturated fatty acids, e.g., molynaphthanate, molyhexanate, molyoleate, molyxanthate and molytallate.

U.S. Pat. No. 4,066,561 teaches organometallic complexes of the formula:

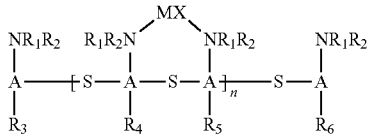

wherein, as defined in the patent, n is an integer of from 1 to about 10, preferably from 1 to about 5; A is an aromatic moiety, preferably phenyl or naphthyl; M is a polyvalent metal, such as, for example, Be, Mg, Ca, Ba, Mn, Co, Ni, Pd, Cu, Zn and Cd; X is a radical selected from the group consisting of organophosphoro, organocarboxyl, organoamino, organosulfonyl, organothio, organooxy, nitrate, nitrite, phosphate, sulfate, sulfonate, oxide, hydroxide, carbonate, sulfite, fluoride, chloride, bromide and iodide; $R_1$ and $R_2$ are alkyl of from 1 to about 10 carbon atoms, aryl, hydrogen,

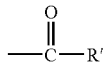

or a combination thereof; R' is alkyl of from 1 to about 10 carbon atoms, aryl or hydrogen; $R_3$, $R_4$, $R_5$ and $R_6$ are hydrogen, alkyl of from 1 to about 200 carbon atoms, aryl, alkyl-substituted aryl where the alkyl substituent is comprised of form 1 to about 200 carbon amounts, carboxyaryl, carbonylaryl, aminoaryl, mercaptoaryl, halogenoaryl or combinations thereof. The metal complexes reportedly stabilize the lubricant to which they are added against oxidation.

U.S. Pat. No. 5,824,627 teaches a lube oil composition containing a major amount of a lube base oil and a minor amount of an additive having the formula $M_{4-y}MO_yS_4L_nQ_z$ and mixtures thereof, wherein M is a metal selected from Cr, Mn, Fe, Co, Ni, Cu, and W, L is independently selected organic groups selected from dithiophosphates, thioxanthates, phosphates, dithiocarbamates, thio-phosphates and xanthates, having a sufficient number of carbon atoms to render the additive soluble or dispersible in the oil, and Q is a neutral electron donating compound, y is 1 to 3, n is 2 to 6, and z is zero to 4, and the L provide a total charge sufficient to neutralize the charge on the $M_{4-y}MO_yS_4$ core.

U.S. Pat. No. 3,649,660 teaches silylorganometallocenes as being useful antioxidants for organopolysiloxane fluids. The silylorganometallocenes are selected from the class of (a) polymers having structural units of the formula

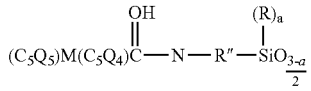

(b) copolymers composed of structural units of the formula

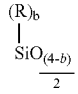

and at least one unit of (a), and
(c) disiloxanes of the formula

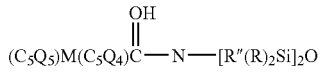

where R is a monovalent hydrocarbon radical, R" is a divalent hydrocarbon radical, and (C5Q4)M(C5Q5) is an organometallocene, where Q is selected from hydrogen, an electron donating organic radical, and an electron withdrawing organic radical and M is a transition metal, a is a whole number equal from 0 to 2 and b is a whole number equal from 0 to 3.

Transition metal is defined to include all metals of Group III to VIII of the Periodic Table capable of forming a π complex with a cyclopentadienyl radical to form a metallocene. The transition metals that are operative in the present invention are, for example, metals having atomic numbers 22 to 28, 40 to 46, and 71 to 78, such as titanium, vanadium, chromium, manganese, iron, cobalt, nickel, zirconium, columbium, molybdenum, technetium, ruthenium, rhodium, palladium, hafnium, tantalum, tungsten, rhenium, osmium, iridium and platinum (see also U.S. Pat. No. 3,745,129).

U.S. Pat. No. 5,015,402 teaches basic metal and multi-metal dihydrocarbyl-phosphorodithioates and phosphoromonothioates as antioxidant additives. These materials are represented by the general formula:

$$[Z]_d[(RO)_2PSS]_yM_aX_b \quad (I)$$

wherein M and X represent different metal cations selected from the group consisting of zinc, copper, chromium, iron, copper, manganese, calcium, barium, lead, antimony, tin and aluminum; Z is an anion selected from oxygen, hydroxide and carbonate; R is independently a linear or branched alkyl group of 1 to about 200 carbon atoms, or a substituted or unsubstituted aryl group of 6 to about 50 carbon atoms; a and b are integers of at least one and are dependent upon the respective oxidation states of M and X; y is a whole integer which is dependent upon the oxidation states of M and X; and d is an integer of 1 or 2.

As a consequence of more stringent and demanding performance and environmental requirements on lubricating oils, for example fill for life oils, sealed bearings oils and greases, or modern extended drain engine lubricating oils to perform better, for longer periods and under more severe conditions of temperature and load over longer times as manifested by current and future lubricating oil specifications, particularly engine oil classifications for diesel lubricants (PC7 and PC8) and passenger car lubricants (GF-3 and GF-4), more efficient, longer lasting and more robust antioxidants are required for use in the lubricants. Increased performance results in improved fuel economy and reduced exhaust emissions in engine systems, e.g., gasoline engine systems and diesel fuel engine systems, where the diesel fuel has a sulfur content ranging in the amount of about 5-1,000 ppm.

DESCRIPTION OF THE INVENTION

The present invention is directed to a lubricating oil exhibiting improved resistance to oxidation and deposit/sludge formation comprising a major amount of lubricant base oil and an effective amount of catalytic antioxidants. The catalytic antioxidants comprise a) an effective amount one or more oil soluble polymetal organometallic compounds containing two or more metals having more than one oxidation state above the ground state, said metals being complexed, bonded or associated with i) two or more anions; ii) one or more polydentate ligands; iii) one or more anions and one or more ligands; or, iv) mixtures thereof. The metals are selected from the group consisting of transition metal elements 21 through 30, excluding nickel, elements 39 through 48, elements 72 though 80, and mixtures thereof. The anion and/or ligand does not itself render the metals inactive, decompose or cause polymerization of the polymetal organometallic compound. Furthermore, when the metals are molybdenum, the ligand is not thiocarbamate, thiophosphate, dithiocarbamate, or dithiophosphate and when the metals are copper, the ligand is not acetyl acetonate. In addition to the one or more oil soluble polymetal organometallic compounds, the catalytic antioxidants comprise effective amounts of b) one or more substituted N,N'-diaryl-o-phenylenediamine compounds or, c) one or more hindered phenol compounds; or, a combination of both (b) and (c). In a preferred embodiment, one or more substituted N,N'-diaryl-o-phenylenediamine compounds and one or more hindered phenol compounds are used in combination with one or more oil soluble polymetal organometallic compounds.

"Polymetal organometallic compounds" means organometallic compounds and organometallic coordination complexes containing two or more of the same or different metal atoms. Preferably, the polymetal organometallic compounds contain between two and four metal atoms. The reactivity of any given metal complex will depend on the ionic strength of the ligands and the coordination geometry around the metal center. These factors will affect the ease with which the metal center can effect the oxidation state change necessary for catalytic decomposition of the hydroperoxide or peroxide species.

In another aspect, the invention is directed to a method for improving the resistance of a lubricating oil to oxidation and deposit/sludge formation comprising adding to the lubricating oil an effective amount of catalytic anti-oxidants. The catalytic antioxidants comprise a) an effective amount of one or more oil soluble polymetal organometallic compounds containing two or more metals having more than one oxidation state above the ground state, said metals being complexed, bonded or associated with i) two or more anions; ii) one or more polydentate ligands; iii) one or more anions and one or more ligands; or, iv) mixtures thereof. The metals are selected from the group consisting of transition metal elements 21 through 30, excluding nickel, elements 39 through 48, elements 72 though 80, and mixtures thereof. The anion and/or ligand does not itself render the metals inactive, decompose or cause polymerization of the polymetal organometallic compound. Furthermore, when the metals are molybdenum, the ligand is not thiocarbamate, thiophosphate, dithiocarbamate, or dithiophosphate and when the metals are copper, the ligand is not acetyl acetonate. In addition to the one or more oil soluble polymetal organometallic compounds, the catalytic antioxidants comprise effective amounts of b) one or more substituted N,N'-diaryl-o-phenylenediamine compounds or, c) one or more hindered phenol compounds; or, a combination of both (b) and (c). In a preferred embodiment, one or more substituted N,N'-diaryl-o-phenylenediamine compounds and one or more hindered phenol compounds are used in combination with one or more oil soluble polymetal organometallic compounds. Preferably, the polymetal organometallic compounds contain between two and four metal atoms.

In another aspect, the invention is directed to an additive concentrate comprising one or more oil soluble polymetal organometallic compounds containing two or more metals having more than one oxidation state above the ground state, said metals being complexed, bonded or associated with i) two or more anions; ii) one or more polydentate ligands; iii) one or more anions and one or more ligands; or, iv) mixtures thereof. The metals are selected from the group consisting of transition metal elements 21 through 30, excluding nickel, elements 39 through 48, elements 72 though 80, and mixtures thereof.

The anion and/or ligand does not itself render the metals inactive, decompose or cause polymerization of the polymetal organometallic compound. Furthermore, when the metals are molybdenum, the ligand is not thiocarbamate, thiophosphate, dithiocarbamate, or dithiophosphate and when the metals are copper, the ligand is not acetyl acetonate. In addition to the one or more oil soluble polymetal organometallic compounds, the catalytic antioxidants comprise effective amounts of b) one or more substituted N,N'-diaryl-o-phenylenediamine compounds or, c) one or more hindered phenol compounds; or, a combination of both (b) and (c); in combination with at least one additional material. In a preferred embodiment, one or more substituted N,N'-diaryl-o-phenylenediamine compounds, one or more hindered phenol compounds, one or more oil soluble polymetal organometallic compounds and at least one additional material are used in combination. The at least one additional material is selected from detergents, dispersants, viscosity index improvers, antiwear additives, friction modifiers, an additional antioxidant, pour-point depressants, corrosion inhibitors, anti-foaming agents, antirust additives, carrier oils seal compatibility additives and the like. Preferably, the polymetal organometallic compounds contain between two and four metal atoms. The catalytic antioxidants of the present invention are utilized in the absence of or in the presence of any added antioxidant. The oil soluble polymetal organometallic compounds do not undergo anion and/or ligand displacement reactions (exchange reaction) which alter the composition and/or stability of the compound rendering them ineffective as a catalytic additive. That is, the original anions and/or ligands which do not fit within the coordination sphere of the metals are not replaced partially or totally by other anions and/or ligands which fit within the coordination sphere of the metals because such partial or total replacement would interfere with the ability of the electrons in the metals orbital to change from one oxidation state above the ground state to another oxidation state above the ground state rendering the compound ineffective as a catalytic antioxidant additive. Compounds which during hydroperoxide decomposition themselves undergo decomposition, e.g., splitting off sulfur, are also excluded insofar as such compounds as a result of such decomposition cease to function as catalytic antioxidants but rather function as, e.g., antiwear additives due to the bonding interaction of the sulfur with the iron of the engine or piece subject to wear.

Base Oil

The lubricating oil formulations of enhanced antioxidancy include but are not limited to greases, gear oils, hydraulic oils, brake fluids, manual and automatic transmission fluids, other energy transferring fluids, tractor fluids, diesel compression ignition engine oils, gasoline spark ignition engine oils, turbine oils and the like. The lubricating base oil may be selected from the group consisting of natural oils, petroleum-derived mineral oils, synthetic oils and mixtures thereof boiling in the lubricating oil boiling range.

The lubricating base oils of the present invention include natural or synthetic oils and unconventional oils of lubricating viscosity; typically those oils having a kinematic viscosity at 100° C. in the range of 2 to 100 cSt, preferably 4 to 50 cSt, more preferably about 8 to 25 cSt.

Natural oils include animal oils, vegetable oils (castor oil and lard oil, for example), and mineral oils. Of the natural oils, mineral oils are preferred. Mineral oils vary widely as to their crude source, for example, as to whether they are paraffinic, naphthenic, or mixed paraffinic-naphthenic. Oils derived from coal or shale are also useful in the present invention.

Synthetic oils include hydrocarbon oils as well as non hydrocarbon oils. Synthetic oils can be derived from processes such as chemical combination (for example, polymerization, oligomerization, condensation, alkylation, acylation, etc.), where materials consisting of smaller, simpler molecular species are built up (i.e., synthesized) into materials consisting of larger, more complex molecular species. Synthetic oils include hydrocarbon oils such as polymerized and interpolymerized olefins (polybutylenes, polypropylenes, propylene isobutylene copolymers, ethylene-olefin copolymers, and ethylene-alphaolefin copolymers, for example).

Polyalphaolefins (PAOs) base stocks are commonly used as synthetic hydrocarbon oil. By way of example, PAOs derived from $C_8$, $C_{10}$, $C_{12}$, $C_{14}$ olefins or mixtures thereof may be utilized. See U.S. Pat. Nos. 4,956,122; 4,827,064; and 4,827,073, which are herein incorporated by reference.

The number average molecular weights of the PAOs, which are known materials and generally available on a major commercial scale from suppliers such as ExxonMobil Chemical Company, Chevron Phillips Chemical Company, BP, and others, typically vary in viscosity from about 250 to about 3,000 cSt (100° C.), although PAOs may be made in viscosities up to about 100 cSt (100° C.). The PAOs are typically comprised of relatively low molecular weight hydrogenated polymers or oligomers of alphaolefins which include, but are not limited to, $C_2$ to about $C_{32}$ alphaolefins with the $C_8$ to about $C_{16}$ alphaolefins, such as 1-octene, 1-decene, 1-dodecene and the like, being preferred. The preferred polyalphaolefins are poly-1-octene, poly-1-decene and poly-1-dodecene and mixtures thereof and mixed olefin-derived polyolefins. However, the dimers of higher olefins in the range of $C_{14}$ to $C_{18}$ may be used to provide low viscosity basestocks of acceptably low volatility. Depending on the viscosity grade and the starting oligomer, the PAOs may be predominantly trimers and tetramers of the starting olefins, with minor amounts of the higher oligomers, having a viscosity range of 1.5 to 12 cSt.

The PAO fluids may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. No. 4,149,178 or U.S. Pat. No. 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487, which are herein incorporated by reference. The dimers of the $C_{14}$ to $C_{18}$ olefins are described in U.S. Pat. No. 4,218,330.

Unconventional base stocks include one or more of a mixture of base stock(s) derived from one or more Gas-to-Liquids (GTL) materials. GTL base oil comprise base stock(s) obtained from a GTL process via one or more synthesis, combination, transformation, rearrangement, and/or degradation deconstructive process from gaseous carbon containing compounds. Preferably, the GTL base stocks are derived from the Fischer-Trospch (FT) synthesis process wherein a synthesis gas comprising a mixture of $H_2$ and CO is catalytically converted to lower boiling materials by hydroisomerisation and/or dewaxing. The process is described, for example, in U.S. Pat. Nos. 5,348,982 and 5,545,674, and suitable catalysts in U.S. Pat. No. 4,568,663, each of which is incorporated herein by reference.

GTL base stock(s) are characterized typically as having kinematic viscosities at 100° C. of from about 2 cSt to about 50 cSt, preferably from about 3 cSt to about 50 cSt, more preferably from about 3.5 cSt to about 30 cSt. The GTL base stock and/or other hydrodewaxed, or hydroisomerized/cat (or solvent) dewaxed wax derived base stock(s) used typically in the present invention have kinematic viscosities in the range of about 3.5 cSt to 7 cSt, preferably about 4 cSt to about 7 cSt, more preferably about 4.5 cSt to 6.5 cSt at 100° C. Reference herein to kinematic viscosity refers to a measurement made by ASTM method D445.

GTL base stocks and base oils derived from GTL base stocks which can be used as base stock components of this invention are further characterized typically as having pour points of about −5° C. or lower, preferably about −10° C. or lower, more preferably about −15° C. or lower, still more preferably about −20° C. or lower, and under some conditions may have advantageous pour points of about −25° C. or lower, with useful pour points of about −30° C. to about −40° C. or lower. In the present invention, however, the GTL base stock(s) used generally are those having pour points of about −30° C. or higher, preferably about −25° C. or higher, more preferably about −20° C. or higher. References herein to pour point refer to measurement made by ASTM D97 and similar automated versions.

The GTL base stock(s) derived from GTL materials, especially hydro-dewaxed or hydroisomerized/cat (or solvent) dewaxed synthetic wax, especially F-T material derived base stock(s) are also characterized typically as having viscosity indices of 80 or greater, preferably 100 or greater, and more preferably 120 or greater. Additionally, in certain particular instances, the viscosity index of these base stocks may be preferably 130 or greater, more preferably 135 or greater, and even more preferably 140 or greater. For example, GTL base stock(s) that derive from GTL materials preferably F-T materials especially F-T wax generally have a viscosity index of 130 or greater. References herein to viscosity index refer to ASTM method D2270. GTL base stock(s) having a kinematic viscosity of at least about 3 cSt at 100° C. and a viscosity index of at least about 130 provide good results.

In addition, the GTL base stock(s) are typically highly paraffinic (>90% saturates), and may contain mixtures of monocycloparaffins and multicyclo-paraffins in combination with non-cyclic isoparaffins. The ratio of the naphthenic (i.e., cycloparaffin) content in such combinations varies with the catalyst and temperature used. Further, GTL base stocks and base oils typically have very low sulfur and nitrogen content, generally containing less than about 10 ppm, and more typically less than about 5 ppm of each of these elements. The sulfur and nitrogen content of GTL base stock(s) obtained by the hydroisomerization/isodewaxing of F-T material, especially F-T wax is essentially nil.

In a preferred embodiment, the GTL base stock(s) comprises paraffinic materials that consist predominantly of non-cyclic isoparaffins and only minor amounts of cycloparaffins. These GTL base stock(s) typically comprise paraffinic materials that consist of greater than 60 wt % non-cyclic isoparaffins, preferably greater than 80 wt % non-cyclic isoparaffins, more preferably greater than 85 wt % non-cyclic isoparaffins, and most preferably greater than 90 wt % non-cyclic isoparaffins based on total GTL base stock composition.

Useful compositions of GTL base stock(s) are recited in U.S. Pat. Nos. 6,080,301; 6,090,989, and 6,165,949 for example, which are herein incorporated by reference.

In the present invention, mixtures of base stock(s), mixtures of the GTL base stock(s), or mixtures thereof, preferably mixtures of GTL base stock(s) provided each component in the mixture has been subjected to a different final wax processing technique, can constitute all or part of the base oil.

The preferred base stocks or base oils derived from GTL materials and/or from waxy feeds are characterized as having predominantly paraffinic compositions and are further characterized as having high saturates levels, low-to-nil sulfur, low-to-nil nitrogen, low-to-nil aromatics, and are essentially water-white in color.

A preferred GTL base stock is one comprising paraffinic hydrocarbon components in which the extent of branching, as measured by the percentage of methyl hydrogens (BI), and the proximity of branching, as measured by the percentage of recurring methylene carbons which are four or more carbons removed from an end group or branch ($CH_2 \geqq 4$), are such that: (a) $BI-0.5(CH_2 \geqq 4)>15$; and (b) $BI+0.85\ (CH_2 \geqq 4)<45$ as measured over said base stock.

The preferred GTL base stock can be further characterized, if necessary, as having less than 0.1 wt % aromatic hydrocarbons, less than 20 wppm nitrogen containing compounds, less than 20 wppm sulfur containing compounds, a pour point of less than −18° C., preferably less than −30° C., a preferred $BI \geqq 25.4$ and $(CH_2 \geqq 4) \leqq 22.5$. They have a nominal boiling point of 370° C.$^+$, on average they average fewer than 10 hexyl or longer branches per 100 carbon atoms and on average have more than 16 methyl branches per 100 carbon atoms. They also can be characterized by a combination of dynamic viscosity, as measured by CCS at −40° C., and kinematic viscosity, as measured at 100° C. represented by the formula: DV (at −40° C.)<2900 (KV at 100° C.)−7000.

The preferred GTL base oil is also characterized as comprising a mixture of branched paraffins characterized in that the lubricant base oil contains at least 90% of a mixture of branched paraffins, wherein said branched paraffins are paraffins having a carbon chain length of about $C_{20}$ to about $C_{40}$, a molecular weight of about 280 to about 562, a boiling range of about 650° F. to about 1050° F., and wherein said branched paraffins contain up to four alkyl branches and wherein the free carbon index of said branched paraffins is at least about 3.

In the above the Branching Index (BI), Branching Proximity ($CH_2 \geqq 4$), and Free Carbon Index (FCI) are determined as follows:

Branching Index

A 359.88 MHz 1H solution NMR spectrum is obtained on a Bruker 360 MHz AMX spectrometer using 10% solutions in $CDCl_3$. TMS is the internal chemical shift reference. $CDCl_3$ solvent gives a peak located at 7.28. All spectra are obtained under quantitative conditions using 90 degree pulse (10.9 μs), a pulse delay time of 30 s, which is at least five times the longest hydrogen spin-lattice relaxation time ($T_1$), and 120 scans to ensure good signal-to-noise ratios.

H atom types are defined according to the following regions:

- 9.2-6.2 ppm hydrogens on aromatic rings;
- 6.2-4.0 ppm hydrogens on olefinic carbon atoms;
- 4.0-2.1 ppm benzylic hydrogens at the α-position to aromatic rings;
- 2.1-1.4 ppm paraffinic CH methine hydrogens;
- 1.4-1.05 ppm paraffinic $CH_2$ methylene hydrogens;
- 1.05-0.5 ppm paraffinic $CH_3$ methyl hydrogens.

The branching index (BI) is calculated as the ratio in percent of non-benzylic methyl hydrogens in the range of 0.5 to 1.05 ppm, to the total non-benzylic aliphatic hydrogens in the range of 0.5 to 2.1 ppm.

Branching Proximity ($CH_2 \geqq 4$)

A 90.5 MHz$^3$CMR single pulse and 135 Distortionless Enhancement by Polarization Transfer (DEPT) NMR spectra are obtained on a Brucker 360 MHzAMX spectrometer using 10% solutions in $CDCL_3$. TMS is the internal chemical shift reference. $CDCL_3$ solvent gives a triplet located at 77.23 ppm in the $^{13}C$ spectrum. All single pulse spectra are obtained under quantitative conditions using 45 degree pulses (6.3 μs), a pulse delay time of 60 s, which is at least five times the longest carbon spin-lattice relaxation time ($T_1$), to ensure complete relaxation of the sample, 200 scans to ensure good signal-to-noise ratios, and WALTZ-16 proton decoupling.

The C atom types $CH_3$, $CH_2$, and CH are identified from the 135 DEPT $^{13}C$ NMR experiment. A major $CH_2$ resonance in all $^{13}C$ NMR spectra at ≈29.8 ppm is due to equivalent recurring methylene carbons which are four or more removed from an end group or branch (CH2>4). The types of branches are determined based primarily on the $^{13}C$ chemical shifts for the methyl carbon at the end of the branch or the methylene carbon one removed from the methyl on the branch.

Free Carbon Index (FCI). The FCI is expressed in units of carbons, and is a measure of the number of carbons in an isoparaffin that are located at least 5 carbons from a terminal carbon and 4 carbons way from a side chain. Counting the terminal methyl or branch carbon as "one" the carbons in the FCI are the fifth or greater carbons from either a straight chain terminal methyl or from a branch methane carbon. These carbons appear between 29.9 ppm and 29.6 ppm in the carbon-13 spectrum. They are measured as follows:

a. calculate the average carbon number of the molecules in the sample which is accomplished with sufficient accuracy for lubricating oil materials by simply dividing the molecular weight of the sample oil by 14 (the formula weight of $CH_2$);
b. divide the total carbon-13 integral area (chart divisions or area counts) by the average carbon number from step a. to obtain the integral area per carbon in the sample;
c. measure the area between 29.9 ppm and 29.6 ppm in the sample; and
d. divide by the integral area per carbon from step b. to obtain FCI.

Branching measurements can be performed using any Fourier Transform NMR spectrometer. Preferably, the measurements are performed using a spectrometer having a magnet of 7.0T or greater. In all cases, after verification by Mass Spectrometry, UV or an NMR survey that aromatic carbons were absent, the spectral width was limited to the saturated carbon region, about 0-80 ppm vs. TMS (tetramethylsilane). Solutions of 15-25 percent by weight in chloroform-d1 were excited by 45 degrees pulses followed by a 0.8 sec acquisition time. In order to minimize non-uniform intensity data, the proton decoupler was gated off during a 10 sec delay prior to the excitation pulse and on during acquisition. Total experiment times ranged from 11-80 minutes. The DEPT and APT sequences were carried out according to literature descriptions with minor deviations described in the Varian or Bruker operating manuals.

DEPT is Distortionless Enhancement by Polarization Transfer. DEPT does not show quaternaries. The DEPT 45 sequence gives a signal for all carbons bonded to protons. DEPT 90 shows CH carbons only. DEPT 135 shows CH and $CH_3$ up and $CH_2$ 180 degrees out of phase (down). APT is Attached Proton Test. It allows all carbons to be seen, but if CH and $CH_3$ are up, then quaternaries and $CH_2$ are down. The sequences are useful in that every branch methyl should have a corresponding CH and the methyls are clearly identified by chemical shift and phase. The branching properties of each sample are determined by C-13 NMR using the assumption in the calculations that the entire sample is isoparaffinic. Corrections are not made for n-paraffins or cycloparaffins, which may be present in the oil samples in varying amounts. The cycloparaffins content is measured using Field Ionization Mass Spectroscopy (FIMS).

GTL base stocks are of low or zero sulfur and phosphorus content. There is a movement among original equipment manufacturers and oil formulators to produce formulated oils of ever increasingly reduced sulfated ash, phosphorus and sulfur content to meet ever increasingly restrictive environmental regulations. Such oils, known as low SAPS oils, would rely on the use of base oils which themselves, inherently, are of low or zero initial sulfur and phosphorus content. Such oils when used as base oils can be formulated with additives. Even if the additive or additives included in the formulation contain sulfur and/or phosphorus the resulting formulated lubricating oils will be lower or low SAPS oils as compared to lubricating oils formulated using conventional mineral oil base stocks.

Low SAPS formulated oils for vehicle engines (both spark ignited and compression ignited) will have a sulfur content of 0.7 wt % or less, preferably 0.6 wt % or less, more preferably 0.5 wt % or less, most preferably 0.4 wt % or less, an ash content of 1.2 wt % or less, preferably 0.8 wt % or less, more preferably 0.4 wt % or less, and a phosphorus content of 0.18% or less, preferably 0.1 wt % or less, more preferably 0.09 wt % or less, most preferably 0.08 wt % or less, and in certain instances, even preferably 0.05 wt % or less.

Base stocks, derived from waxy feeds, which are also suitable for use in this invention, are paraffinic fluids of lubricating viscosity derived from hydrodewaxed, or hydroisomerized/catalytically (or solvent) dewaxed waxy feedstocks of mineral oil, non-mineral oil, non-petroleum, or natural source origin, e.g., feedstocks such as one or more of gas oils, slack wax, waxy fuels hydrocracker bottoms, hydrocarbon raffinates, natural waxes, hyrocrackates, thermal crackates, foots oil, wax from coal liquefaction or from shale oil, or other suitable mineral oil, non-mineral oil, non-petroleum, or natural source derived waxy materials, linear or branched hydrocarbyl compounds with carbon number of about 20 or greater, preferably about 30 or greater, and mixtures of such isomerate/isodewaxate base stocks and base oils.

Slack wax is the wax recovered from any waxy hydrocarbon oil including synthetic oil such as F-T waxy oil or petroleum oils by solvent or autorefrigerative dewaxing. Solvent dewaxing employs chilled solvent such as methyl ethyl ketone (MEK), methyl isobutyl ketone (MIBK), mixtures of MEK/MIBK, mixtures of MEK and toluene, while autorefrigerative dewaxing employs pressurized, liquefied low boiling hydrocarbons such as propane or butane. Slack wax(es) secured from synthetic waxy oils such as F-T waxy oil will usually have zero or nil sulfur and/or nitrogen containing compound content. Slack wax(es) secured from petroleum oils, may contain sulfur and nitrogen containing compounds. Such heteroatom compounds must be removed by hydrotreating (and not hydrocracking), as for example by hydrodesulfurization (HDS) and hydrodenitrogenation (HDN) so as to avoid subsequent poisoning/deactivation of the hydroisomerization catalyst.

Formulated lubricant compositions comprise a mixture of a base stock or a base oil and at least one performance additive. Usually, the base stock is a single oil secured from a single crude source and subjected to a single processing scheme and meeting a particular specification. Base oils comprise at least one base stock. The base oil constitutes the major component of the lubricating oil composition and typically is present in an amount ranging from about 50 wt. % to about 99 wt. %, e.g., from about 85 wt. % to about 95 wt. %, based on the total weight of the composition.

Catalytic Hydroperoxide Decomposers/Antioxidants

The lubricating base oil of the present invention also comprises an effective amount of catalytic antioxidants. The catalytic antioxidants comprise an effective amount of a) one or more oil soluble polymetal organometallic compounds; and, effective amounts of b) one or more substituted N,N'-diaryl-o-phenylenediamine compounds or c) one or more hindered phenol compounds; or a combination of both b) and c). In a preferred embodiment, the catalytic antioxidants comprise effective amounts of a) one or more oil soluble polymetal organometallic compounds, b) one or more substituted N,N'-diaryl-o-phenylenediamine compounds and c) one or more hindered phenol compounds. In a more preferred embodiment, the catalytic antioxidants consist essentially of an effective amount of a) one or more oil soluble polymetal organometallic compounds; and, effective amounts of b) one or more substituted N,N'-diaryl-o-phenylenediamine compounds or c) one or more hindered phenol compounds; or, a combination of both b) and c). In a most preferred embodiment, the catalytic antioxidants consist essentially of effective amounts of a) one or more oil soluble polymetal organometallic compounds, b) one or more substituted N, N'-diaryl-o-phenylenediamine compounds and c) one or more hindered phenol compounds. "Consisting essentially of" means that the formulation does not contain any significant amount of other antioxidants.

Polymetal Organometallic Catalytic Hydroperoxide Decomposers/Antioxidant

Polymetal organometallic compounds comprising metals and anions and/or ligands have been found to be catalytic antioxidant hydroperoxide decomposers in the presence of other peroxide decomposer compounds. In particular, polymetal organometallic compounds have been found to have a synergistic effect when used in the presence of other peroxide decomposer compounds. The metals of the polymetal organometallic compounds have more than one oxidation state above the ground state. The anions and/or ligands of the polymetal organometallic compounds do not render the metal cations inactive. That is, the anions and/or ligands do not render the metal cations unable to change from one oxidation state above the ground state to another oxidation stated above the ground state. Additionally, the anions and/or ligands of the polymetal organometallic compounds do not cause polymerization of the metal salts. Nor are the anions and/or ligands susceptible to decomposition thereby rendering the metals inactive.

The following formula generally represents the polymetal organometallic compounds of the present invention $$[M^n(\text{Ligand})]_y$$

where M is the metal or metal cation;

n is the oxidation state;

y is the number of metal cations in the complex and is $\geqq 2$; and

Ligand is the organic anionic and/or ligand moiety complexing the metal.

The metal component having more than one oxidation state above the ground state of the polymetal organometallic compound catalytic hydroperoxide decomposer is selected from the group consisting of transition metal elements 21 through 30, excluding nickel, elements 39 through 48, elements 72 through 80, metals of the lanthanide series, metals of the actinide series and mixtures thereof. Preferably, the metal component is selected from the group consisting of transition metal elements 21 through 30, excluding nickel, elements 39 through 48, elements 72 though 80 and mixtures thereof. More preferably, the metal component is selected from the group consisting of transition metal elements 21 through 30, excluding nickel, elements 39 though 48, elements 72 through 80 and mixtures thereof. Still more preferably the metal component is selected from the group consisting of transition metal elements 21 though 30 excluding nickel, elements 39 through 48 excluding molybdenum, elements 72 through 80 and mixtures thereof Even more preferably, the metal component is selected from the group consisting of manganese, cobalt, iron, copper, chromium and zinc.

The metals exhibit more than one oxidation state above ground state and the anions and/or ligand with which they complex to form the polymetal organometallic compound do not interfere with the ability of the metals' orbital to change from one oxidation state above the ground state to another oxidation state above the ground state.

In the practice of the present invention the polymetal organometallic compound is employed in an effective amount, it having been found that the polymetal organometallic compound is not consumed on a stoichiometric basis by the hydroperoxide, but rather itself reacts with at least 380 equivalent of hydroperoxide per equivalent of metal or metal complex, preferably at least about 400 equivalents of hydroperoxide per equivalent of metal or metal complex, more preferably at least about 420 equivalents of hydroperoxide per equivalent of metal or metal complex. Thus, the catalytic antioxidant polymetal organometallic compound can be utilized in an effective amount, typically an amount in the range of about 1 to 1000 ppm by weight based on the total amount of lubricant base oil, preferably about 25 to 1000 ppm, more preferably about 10 to 500 ppm.

In the polymetal organometallic compounds useful in the present invention, the organic anionic and/or ligand moiety complexing the metals can be either neutral (e.g., bipyridyl) or anionic (e.g., acac). To avoid either self-polymerization or polymerization with/through other species in the oil, the ligands, generally, should avoid high levels of polar functionality, high-polarity atoms in the functional groups, reactive structures such as olefins, and unstable geometries whose strain energy could be relieved through polymerization.

Such organic moiety include materials derived from salicylic acid, salicylic aldehyde, carboxylic acids which may be aromatic acids, naphthenic acids, aliphatic acids, cyclic, branched aliphatic acids and mixtures thereof. Among the useful ligands are acetylacetonate, naphthenates, phenates, stearates, carboxylates, etc. Preferred ligands are polydentate Schiff base ligands which are the reaction products of salicylic aldehyde and diamines. Preferred polydentate Schiff base ligands include N,N'-disalicylidene-1,3-diaminopropane (H2Salpn) and N,N'-disalicylidene-1,4-diaminobutane (H2Salbn) ligands, H2Salpn ligands being the most preferred. Nitrogen-, oxygen-, sulfur-, and phosphorus-containing ligands, preferably oxygen-, nitrogen-, or oxygen and nitrogen-containing ligands (e.g., bipyridines, thiophenes, thiones, carbamates, phosphates, thiocarbamates, thiophosphates, dithiocarbamates, dithiophosphates, etc.), also give rise to useful polymetal organometallic compounds provided the metal orbital remain free to exhibit its ability to change from one oxidation state above the ground state to another oxidation state above the ground state. It is necessary that the polymetal organometallic compound not be polymerized, but remain as individual molecules. Polymerization as is typically encountered with materials such as the molybdenum dithiocarbamates reported in the literature as antiwear agents prevents the material from functioning as a catalytic antioxidant/hydroperoxide decomposer because through polymerization the metal orbitals are satisfied in their quest for electrons and become stabilized, thus losing the ability to shift from one oxidation state above the ground state to another oxidation state above the ground state, which has been found necessary for a polymetal organo metallic compound to function as a catalyst hydroperoxide decomposer. In the case where the metals are molybdenum, the ligand is not thiocarbamate, thiophosphate, dithiocarbamate or dithiophosphate or where the metals are copper the ligand is not acetyl acetonate.

The polymetal organometallic compounds of the present invention are oil soluble and may be prepared according to J. A. Bonadies, M. L. Kirk, M. S. Lah, D. P. Kessissoglou, W. E. Hatfield, and V. L. Pecoraro, *Structure Diverse Manganese (III) Schiff Base Complexes: Chains, Dimers and Cages,* 28, Inorganic Chemistry, 2037-2044 (1989), E. J. Larson and V. L. Pecoraro, *The Peroxide-Dependent $\mu_2$-O Bond Formation of $[Mn^{IV}SALPN(O)]_2$*, 113, J. Am. Chem. Soc., 3810-3818 (1991) and V. L. Pecoraro, J. E. Penner-Hahn and A. J. Wu,

*Structural, Spectroscopic, and Reactivity Models for the Manganese Catalases,* 104, Chem. Rev., 903-908 (2004), which are herein incorporated by reference. For example, Larson and Pecoraro in *The Peroxide-Dependent $\mu_2$-O Bond Formation of $[Mn^{IV}SALPN(O)]_2$* at page 3811 teach that $[Mn^{III}(SALPN)(AcAc)]$ is made by adding 20 mmol (3.13 g) of salicylaldehyde and 10 mmol (0.833 mL) of 1,3-diaminopropane to 150 mL of methanol under reflux. After the solution is refluxed for 15 minutes, 10 mmol (3.52 g) of $Mn(AcAc)_3$ is added to the solution. The solution is subsequently cooled to −20° C. $[Mn^{III}(SALPN)(AcAc)]$ is precipitated and recovered by suction filtration. $[Mn^{IV}(SALPN)(O)]_2$ is made by dissolving 10 mmol (4.34 g) of $[Mn^{III}(SALPN)(AcAc)]$ in acetonitrile with no effort to exclude water or $O_2$. Hydrogen peroxide (50% aqueous, 1.2 equiv) is added to the solution. The solution turns a blood red and platelike crystals form. The solution is subsequently cooled to −10° C. and suction filtered yielding 100% of $[Mn^{IV}(SALPN)(O)]_2$.

Preferred polymetal organometallic compounds include $[MnIII\ (2\text{-}OHsalpn)]_2$, $[MnIII(2\text{-}OHsalpn)]_2$ II, $[MnIII(5\text{-}Cl\text{-}2\text{-}OH\text{-}salpn)]_2$, $[MnIII(5\text{-}NO2\text{-}2\text{-}OH\text{-}salpn)]_2$, $[MnIV(salpn)(\mu\text{-}O)]_2$, $[MnIV(5\text{-}Cl\text{-}salpn)(\mu\text{-}O)]_2$, $[MnIV(5\text{-}OCH3\text{-}salpn)(\mu\text{-}O)]_2$, $[MnIV(5\text{-}NO2\text{-}salpn)(\mu\text{-}O)]_2$, $[MnIV(3,5\text{-}di\text{-}Cl\text{-}salpn)(\mu\text{-}O)]_2$, $MnII(OAc)_2[12\text{-}MCMnIIIshi\text{-}4]$, $\{Li(LiCl2[12\text{-}MCMnIIIshi\text{-}4])\}$ and $MnII(OAc)_2[15\text{-}MCMnIIIshi\text{-}5]$, most preferred is $[MnIV(salpn)(\mu\text{-}O)]_2$.

Substituted N,N'-Diaryl-o-Phenylenediamine Catalytic Hydroperoxide Decomposers/Antioxidant N,N'-diaryl-o-phenylenediamines are catalytic antioxidants also used according to the invention, preferably those N,N'-diaryl-o-phenylenediamines having Formula I

I

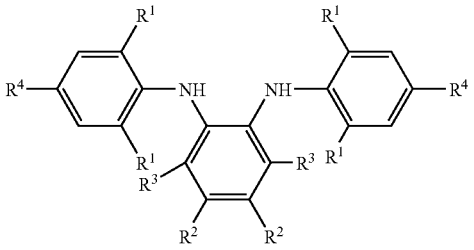

where $R^1$ is H or $C_1$ to $C_{12}$ alkyl, $R^2$ is H or $C_1$ to $C_{12}$ alkyl, and $R^3$ and $R^4$ are independently H or $C_1$ to $C_{12}$ alkyl. The average molecular weight of the substituted N,N'-diaryl-o-phenylenediamine antioxidant will range from about 200 to about 600, preferably from about 300 to about 500.

Suitable compounds of Formula I include

I-a

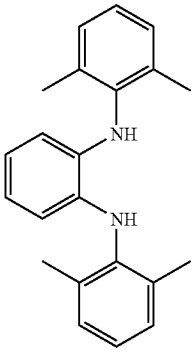

-continued

I-b

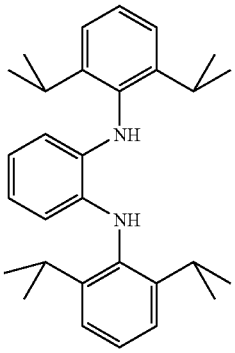

I-c

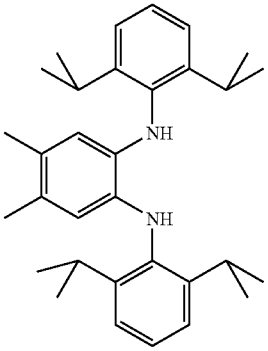

I-d

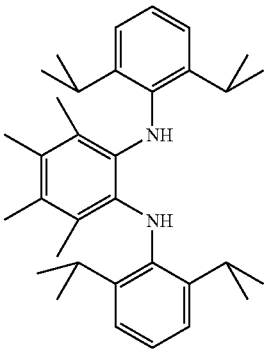

Preferably, $R^1$ is $C_1$ to $C_{10}$ alkyl, most preferably, an alkyl selected from methyl, ethyl, n-propyl, iso-propyl, n-butyl, iso-butyl, tert-butyl and octyl, conveniently a methyl or iso-propyl.

In a separate preferred embodiment, $R^1$ is a methyl and $R^2$, $R^3$ and $R^4$ are independently H or methyl.

Unsubstituted N,N'-diaryl-o-phenylenediamines, preferably N,N'-diphenyl-o-phenylenediamine (compound of Formula I, where $R^1 = R^2 = R^3 = R^4 = H$), are also effective antioxidants.

Preferably, the substituted N,N'-diaryl-o-phenylenediamine antioxidant is an isopropyl substituted N,N'-diaryl-o-phenylenediamine antioxidant, more preferably a t-butyl substituted N,N'-diaryl-o-phenylenediamine antioxidant, still more preferably a methyl substituted N,N'-diaryl-o-phenylenediamine antioxidant. Without being bound to any particular theory, it is believed that steric hindrance plays an important role in the antioxidants ability to combat oxidative properties in oils. While some steric hindrance allows for a proton to be donated to an oxidative radical, too much steric hindrance crowds the proton making it unavailable to radicals.

Substituted N,N'-diaryl-o-phenylenediamine compounds may be used in an amount of about 0.001 to 1.0 wt % based on the total amount of lubricant base oil, preferably about 0.01 to 0.5 wt %, more preferably 0.05 to less than 0.1 wt %.

The meta- and para-substituted N,N'-diaryl-phenylenediamine compounds are also effective catalytic antioxidants.

Hindered Phenol Catalytic Hydroperoxide Decomposers/Antioxidant

Hindered phenol compounds are also used as catalytic antioxidants according to the present invention. These phenolic antioxidants may be ashless (metal-free) phenolic compounds or neutral or basic metal salts of certain phenolic compounds. Typical phenolic antioxidant compounds are the hindered phenolics which are the ones that contain a sterically hindered hydroxyl group, and these include those derivatives of dihydroxy aryl compounds in which the hydroxyl groups are in the o- or p-position to each other. Typical phenolic antioxidants include the hindered phenols substituted with $C_6$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include for example hindered 2,6-di-alkyl-phenolic proprionic ester derivatives. Bis-phenolic antioxidants may also be advantageously used in combination with the instant invention. Examples of ortho-coupled phenols include: 2,2'-bis(4-heptyl-6-t-butyl-phenol); 2,2'-bis(4-octyl-6-t-butyl-phenol); and 2,2'-bis(4-dodecyl-26-t-butyl-phenol). Preferred bisphenols include para-coupled bisphenols having Formula II

II

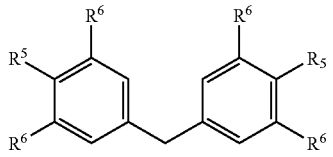

wherein $R^5$ is an H or OH group and $R^6$ is $C_1$-$C_8$ alkyl group, preferably $C_4$ alkyl group.

Examples of para-coupled bisphenols include 4,4'-bis(2,6-di-t-butyl phenol) and 4,4'-methylene-bis(2,6-di-t-butyl phenol). More preferably, the para-coupled bisphenol is 4,4'-methylene-bis(2,6-di-t-butyl phenol).

Hindered phenol compounds may be used in an amount of about 0.001 to 1.0 wt % based on the total amount of lubricant base oil, preferably about 0.01 to 0.5 wt %, more preferably 0.05 to less than 0.1 wt %.

Other components, including effective amounts of co-base stocks, and various performance additives can be advantageously used with the components of this invention. Co-base stocks include polyalphaolefin oligomeric low- and moderate- and high-viscosity oils, dibasic acid esters, polyol esters, other hydrocarbon oils such as those derived from gas to liquids type technology, supplementary hydrocarbyl aromatics and the like.

The instant invention can be used with additional lubricant components, as set forth in Table 1, in effective amounts in lubricant compositions, such as for example polar and/or non-polar lubricant base oils, and performance additives such as for example, but not limited to, supplementary oxidation inhibitors which are not themselves peroxide decomposers, metallic and non-metallic dispersants, metallic and non-metallic detergents, corrosion and rust inhibitors, metal deactivators, anti-wear agents (metallic and non-metallic, phosphorus-containing and non-phosphorus, sulfur-containing and non-sulfur types), extreme pressure additives (metallic and non-metallic, phosphorus-containing and non-phosphorus, sulfur-containing and non-sulfur types), anti-seizure agents, pour point depressants, wax modifiers, viscosity modifiers, seal compatibility agents, friction modifiers, lubricity agents, anti-staining agents, chromophoric agents, defoamants, demulsifiers, and others. For a review of many commonly used additives see Klamann in Lubricants and Related Products, Verlag Chemie, Deerfield Beach, Fla. ISBN 0-89573-177-0, which also gives a good discussion of a number of the lubricant additives mentioned below. Reference is also made "Lubricant Additives" by M. W. Ranney, published by Noyes Data Corporation of Parkridge, N.J. (1978).

Antiwear and EP Additives

Internal combustion engine lubricating oils require the presence of antiwear and/or extreme pressure (EP) additives in order to provide adequate antiwear protection for the engine. Increasingly specifications for engine oil performance have exhibited a trend for improved antiwear properties of the oil. Antiwear and extreme EP additives perform this role by reducing friction and wear of metal parts.

While there are many different types of antiwear additives, for several decades the principal antiwear additive for internal combustion engine crankcase oils is a metal alkylthiophosphate and more particularly a metal dialkyldithiophosphate in which the primary metal constituent is zinc, or zinc dialkyldithiophosphate (ZDDP). ZDDP compounds generally are of the formula $Zn[SP(S)(OR^7)(OR^8)]_2$ where $R^7$ and $R^8$ are $C_1$-$C_{18}$ alkyl groups, preferably $C_2$-$C_{12}$ alkyl groups. These alkyl groups may be straight chain or branched. The ZDDP is typically used in amounts of from about 0.4 to 1.4 wt % of the total lube oil composition, although more or less can often be used advantageously.

However, it is found that the phosphorus from these additives has a deleterious effect on the catalyst in catalytic converters and also on oxygen sensors in automobiles. One way to minimize this effect is to replace some or all of the ZDDP with phosphorus-free antiwear additives.

A variety of non-phosphorous additives are also used as antiwear additives. Sulfurized olefins are useful as antiwear and EP additives. Sulfur-containing olefins can be prepared by sulfurization or various organic materials including aliphatic, arylaliphatic or alicyclic olefinic hydrocarbons containing from about 3 to 30 carbon atoms, preferably 3-20 carbon atoms. The olefinic compounds contain at least one non-aromatic double bond. Such compounds are defined by the formula $$R^9R^{10}C{=}CR^{11}R^{12}$$

where each of $R^9$-$R^{12}$ are independently hydrogen or a hydrocarbon radical. Preferred hydrocarbon radicals are alkyl or alkenyl radicals. Any two of $R^9$-$R^{12}$ may be connected so as to form a cyclic ring. Additional information concerning sulfurized olefins and their preparation can be found in U.S. Pat. No. 4,941,984, incorporated by reference herein in its entirety.

The use of polysulfides of thiophosphorus acids and thiophosphorus acid esters as lubricant additives is disclosed in U.S. Pat. Nos. 2,443,264; 2,471,115; 2,526,497; and 2,591,577. Addition of phosphorothionyl disulfides as an antiwear, antioxidant, and EP additive is disclosed in U.S. Pat. No. 3,770,854. Use of alkylthiocarbamoyl compounds (bis(dibutyl)thiocarbamoyl, for example) in combination with a molybdenum compound (oxymolybdenum diisopropylphosphorodithioate sulfide, for example) and a phosphorous ester (dibutyl hydrogen phosphite, for example) as antiwear additives in lubricants is disclosed in U.S. Pat. No. 4,501,678. U.S. Pat. No. 4,758,362 discloses use of a carbamate additive to provide improved antiwear and extreme pressure properties. The use of thiocarbamate as an antiwear additive is disclosed in U.S. Pat. No. 5,693,598. Thiocarbamate/molybdenum complexes such as moly-sulfur alkyl dithiocarbamate trimer complex (R=$C_8$-$C_{18}$ alkyl) are also useful antiwear agents. The use or addition of such materials should be kept to a minimum if the object is to produce low SAP formulations. Each of the aforementioned patents is incorporated by reference herein in its entirety.

Esters of glycerol may be used as antiwear agents. For example, mono-, di, and tri-oleates, mono-palmitates and mono-myristates may be used.

ZDDP is combined with other compositions that provide antiwear properties. U.S. Pat. No. 5,034,141 discloses that a combination of a thiodixanthogen compound (octylthiodixanthogen, for example) and a metal thiophosphate (ZDDP, for example) can improve antiwear properties. U.S. Pat. No. 5,034,142 discloses that use of a metal alkyoxyalkylxanthate (nickel ethoxyethylxanthate, for example) and a dixanthogen (diethoxyethyl dixanthogen, for example) in combination with ZDDP improves antiwear properties. Each of the aforementioned patents is incorporated herein by reference in its entirety.

Preferred antiwear additives include phosphorus and sulfur compounds such as zinc dithiophosphates and/or sulfur, nitrogen, boron, molybdenum phosphorodithioates, molybdenum dithiocarbamates and various organomolybdenum derivatives including heterocyclics, for example dimercaptothiadiazoles, mercaptobenzothiadiazoles, triazines, and the like, alicyclics, amines, alcohols, esters, diols, triols, fatty amides and the like can also be used. Such additives may be used in an amount of about 0.01 to 6 wt %, preferably about 0.01 to 4 wt %. ZDDP-like compounds provide limited hydroperoxide decomposition capability, significantly below that exhibited by compounds disclosed and claimed in this patent and can therefore be eliminated from the formulation or, if retained, kept at a minimal concentration to facilitate production of low SAP formulations.

Viscosity Index Improvers

Viscosity index improvers (also known as VI improvers, viscosity modifiers, and viscosity improvers) provide lubricants with high and low temperature operability. These additives impart shear stability at elevated temperatures and acceptable viscosity at low temperatures.

Suitable viscosity index improvers include high molecular weight hydrocarbons, polyesters and viscosity index improver dispersants that function as both a viscosity index improver and a dispersant. Typical molecular weights of these polymers are between about 10,000 to 1,000,000, more typically about 20,000 to 500,000, and even more typically between about 50,000 and 200,000.

Examples of suitable viscosity index improvers are polymers and copolymers of methacrylate, butadiene, olefins, or alkylated styrenes. Polyisobutylene is a commonly used viscosity index improver. Another suitable viscosity index improver is polymethacrylate (copolymers of various chain length alkyl methacrylates, for example), some formulations of which also serve as pour point depressants. Other suitable viscosity index improvers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

Viscosity index improvers may be used in an amount of about 0.01 to 8 wt %, preferably about 0.01 to 4 wt %.

Other Antioxidants

Antioxidants retard the oxidative degradation of base oils during service. Such degradation may result in deposits on metal surfaces, the presence of sludge, or a viscosity increase in the lubricant. One skilled in the art knows a wide variety of oxidation inhibitors that are useful in lubricating oil compositions. See, Klamann in Lubricants and Related Products, op cite, and U.S. Pat. Nos. 4,798,684 and 5,084,197, for example.

Non-phenolic oxidation inhibitors which may be used include aromatic amine antioxidants and these may be used either as such or in combination with phenolics. Typical examples of non-phenolic antioxidants include: alkylated and non-alkylated aromatic amines such as aromatic monoamines of the formula $R^{13}R^{14}R^{15}N$ where $R^{13}$ is an aliphatic, aromatic or substituted aromatic group, $R^{14}$ is an aromatic or a substituted aromatic group, and $R^{15}$ is H, alkyl, aryl or $R^{16}S(O)_xR^{17}$ where $R^{16}$ is an alkylene, alkenylene, or aralkylene group, $R^{17}$ is a higher alkyl group, or an alkenyl, aryl, or alkaryl group, and x is 0, 1 or 2. The aliphatic group $R^{13}$ may contain from 1 to about 20 carbon atoms, and preferably contains from about 6 to 12 carbon atoms. The aliphatic group is a saturated aliphatic group. Preferably, both $R^{13}$ and $R^{14}$ are aromatic or substituted aromatic groups, and the aromatic group may be a fused ring aromatic group such as naphthyl. Aromatic groups $R^{14}$ and $R^{14}$ may be joined together with other groups such as S.

Typical aromatic amines antioxidants have alkyl substituent groups of at least about 6 carbon atoms. Examples of aliphatic groups include hexyl, heptyl, octyl, nonyl, and decyl. Generally, the aliphatic groups will not contain more than about 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present invention include: p,p'-dioctyldiphenylamine; t-octylphenyl-alpha-naphthylamine; phenyl-alphanaphthylamine; and p-octylphenyl-alpha-naphthylamine.

Sulfurized alkyl phenols and alkali or alkaline earth metal salts thereof also are useful antioxidants.

Another class of antioxidant used in lubricating oil compositions is oil-soluble copper compounds. Any oil-soluble suitable copper compound may be blended into the lubricating oil. Examples of suitable copper antioxidants include copper dihydrocarbyl thio or dithio-phosphates and copper salts of carboxylic acid (naturally occurring or synthetic). Other suitable copper salts include copper dithiacarbamates, sulphonates, phenates, and acetylacetonates. Basic, neutral, or acidic copper Cu(I) and or Cu(II) salts derived from alkenyl succinic acids or anhydrides are know to be particularly useful.

Preferred antioxidants include hindered phenols, arylamines. These antioxidants may be used individually by type or in combination with one another. Such additives may be used in an amount of about 0.01 to 5 wt %, preferably about 0.01 to 1.5 wt %, more preferably zero to less than 1.5 wt %.

Detergents

Detergents are commonly used in lubricating compositions. A typical detergent is an anionic material that contains a long chain hydrophobic portion of the molecule and a smaller anionic or oleophobic hydrophilic portion of the molecule. The anionic portion of the detergent is typically derived from an organic acid such as a sulfur acid, carboxylic acid, phosphorous acid, phenol, or mixtures thereof. The counterion is typically an alkaline earth or alkali metal.

Salts that contain a substantially stochiometric amount of the metal are described as neutral salts and have a total base number (TBN, as measured by ASTM D2896) of from 0 to 80. Many compositions are overbased, containing large amounts of a metal base that is achieved by reacting an excess of a metal compound (a metal hydroxide or oxide, for example) with an acidic gas (such as carbon dioxide). Useful detergents can be neutral, mildly overbased, or highly overbased.

It is desirable for at least some detergent to be overbased. Overbased detergents help neutralize acidic impurities produced by the combustion process and become entrapped in the oil. Typically, the overbased material has a ratio of metallic ion to anionic portion of the detergent of about 1.05:1 to 50:1 on an equivalent basis. More preferably, the ratio is from about 4:1 to about 25:1. The resulting detergent is an overbased detergent that will typically have a TBN of about 150 or higher, often about 250 to 450 or more. Preferably, the overbasing cation is sodium, calcium, or magnesium. A mixture of detergents of differing TBN can be used in the present invention.

Preferred detergents include the alkali or alkaline earth metal salts of sulfonates, phenates, carboxylates, phosphates, and salicylates.

Sulfonates may be prepared from sulfonic acids that are typically obtained by sulfonation of alkyl substituted aromatic hydrocarbons. Hydro-carbon examples include those obtained by alkylating benzene, toluene, xylene, naphthalene, biphenyl and their halogenated derivatives (chlorobenzene, chlorotoluene, and chloronaphthalene, for example). The alkylating agents typically have about 3 to 70 carbon atoms. The alkaryl sulfonates typically contain about 9 to about 80 carbon or more carbon atoms, more typically from about 16 to 60 carbon atoms.

Klamann in Lubricants and Related Products, op cit discloses a number of overbased metal salts of various sulfonic acids which are useful as detergents and dispersants in lubricants. The book entitled "Lubricant Additives", C. V. Smallheer and R. K. Smith, published by the Lezius-Hiles Co. of Cleveland, Ohio (1967), similarly discloses a number of overbased sulfonates that are useful as dispersants/detergents.

Alkaline earth phenates are another useful class of detergent. These detergents can be made by reacting alkaline earth metal hydroxide or oxide (CaO, $Ca(OH)_2$, BaO, $Ba(OH)_2$, MgO, $Mg(OH)_2$, for example) with an alkyl phenol or sulfurized alkylphenol. Useful alkyl groups include straight chain or branched $C_1$-$C_{30}$ alkyl groups, preferably, $C_4$-$C_{20}$. Examples of suitable phenols include isobutylphenol, 2-ethylhexylphenol, nonylphenol, dodecyl phenol, and the like. It should be noted that starting alkylphenols may contain more than one alkyl substituent that are each independently straight chain or branched. When a non-sulfurized alkylphenol is used, the sulfurized product may be obtained by methods well known in the art. These methods include heating a mixture of alkylphenol and sulfurizing agent (including elemental sulfur, sulfur halides such as sulfur dichloride, and the like) and then reacting the sulfurized phenol with an alkaline earth metal base.

Metal salts of carboxylic acids are also useful as detergents. These carboxylic acid detergents may be prepared by reacting a basic metal compound with at least one carboxylic acid and removing free water from the reaction product. These compounds may be overbased to produce the desired TBN level. Detergents made from salicylic acid are one preferred class of detergents derived from carboxylic acids. Useful salicylates include long chain alkyl salicylates. One useful family of compositions is of the formula

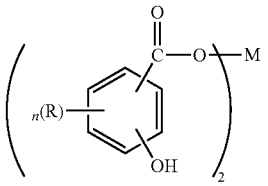

where R is a hydrogen atom or an alkyl group having 1 to about 30 carbon atoms, n is an integer from 1 to 4, and M is an alkaline earth metal. Preferred R groups are alkyl chains of at least $C_{11}$, preferably $C_{13}$ or greater. R may be optionally substituted with substituents that do not interfere with the detergent's function. M is preferably, calcium, magnesium, or barium. More preferably, M is calcium.

Hydrocarbyl-substituted salicylic acids may be prepared from phenols by the Kolbe reaction. See U.S. Pat. No. 3,595,791, which is incorporated herein by reference in its entirety, for additional information on synthesis of these compounds. The metal salts of the hydrocarbyl-substituted salicylic acids may be prepared by double decomposition of a metal salt in a polar solvent such as water or alcohol.

Alkaline earth metal phosphates are also used as detergents.

Detergents may be simple detergents or what is known as hybrid or complex detergents. The latter detergents can provide the properties of two detergents without the need to blend separate materials. See U.S. Pat. No. 6,034,039 for example.

Preferred detergents include calcium phenates, calcium sulfonates, calcium salicylates, magnesium phenates, magnesium sulfonates, magnesium salicylates and other related components (including borated detergents). Typically, the total detergent concentration is about 0.1 to about 3.5 wt %, preferably, about 1.0 to 2.0 wt %.

Dispersant

During engine operation, oil-insoluble oxidation byproducts are produced. Dispersants help keep these byproducts in solution, thus diminishing their deposition on metal surfaces. Dispersants may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

Chemically, many dispersants may be characterized as phenates, sulfonates, sulfurized phenates, salicylates, naphthenates, stearates, carbamates, thiocarbamates, phosphorus derivatives. A particularly useful class of dispersants are the alkenylsuccinic derivatives, typically produced by the reaction of a long chain substituted alkenyl succinic compound, usually a substituted succinic anhydride, with a polyhydroxy or polyamino compound. The long chain group constituting the oleophilic portion of the molecule which confers solubility in the oil, is normally a polyisobutylene group. Many examples of this type of dispersant are well known commercially and in the literature. Exemplary U.S. patents describing such dispersants are U.S. Pat. Nos. 3,172,892; 3,2145,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,5725,277; 3,725,480; 3,726,882; 4,454,059; 3,329,658; 3,449,250; 3,519,565; 3,666,730; 3,687,849; 3,702,300; 4,5100,082; 5,705,458. A further description of dispersants may be found, for example, in European Patent Application No. 471 071, to which reference is made for this purpose.

Hydrocarbyl-substituted succinic acid compounds are popular dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between alkenyl succinic anhydrides and amines. Molar ratios can vary depending on the polyamine. For example, the molar ratio of alkenyl succinic anhydride to TEPA can vary from about 1:1 to about 5:1. Representative examples are shown in U.S. Pat. Nos. 3,087,936; 3,172,892; 3,219,666; 3,272,746; 3,322,670; and 3,652,616, 3,948,800; and Canada Pat. No. 1,094,044.

Succinate esters are formed by the condensation reaction between alkenyl succinic anhydrides and alcohols or polyols. Molar ratios can vary depending on the alcohol or polyol used. For example, the condensation product of an alkenyl succinic anhydride and pentaerythritol is a useful dispersant.

Succinate ester amides are formed by condensation reaction between alkenyl succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine. Representative examples are shown in U.S. Pat. No. 4,426,305.

The molecular weight of the alkenyl succinic anhydrides used in the preceding paragraphs will typically range between 800 and 2,500. The above products can be post-reacted with various reagents such as sulfur, oxygen, formaldehyde, carboxylic acids such as oleic acid, and boron compounds such as borate esters or highly borated dispersants. The dispersants can be borated with from about 0.1 to about 5 moles of boron per mole of dispersant reaction product.

Mannich base dispersants are made from the reaction of alkylphenols, formaldehyde, and amines. See U.S. Pat. No. 4,767,551, which is incorporated herein by reference. Process aids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039.

Typical high molecular weight aliphatic acid modified Mannich condensation products useful in this invention can be prepared from high molecular weight alkyl-substituted hydroxyaromatics or $HN(R)_2$ group-containing reactants.

Examples of high molecular weight alkyl-substituted hydroxyaromatic compounds are polypropylphenol, polybutylphenol, and other polyalkylphenols. These polyalkylphenols can be obtained by the alkylation, in the presence of an alkylating catalyst, such as $BF_3$, of phenol with high molecular weight polypropylene, polybutylene, and other polyalkylene compounds to give alkyl substituents on the benzene ring of phenol having an average 600-100,000 molecular weight.

Examples of $HN(R)_2$ group-containing reactants are alkylene polyamines, principally polyethylene polyamines. Other representative organic compounds containing at least one $HN(R)_2$ group suitable for use in the preparation of Mannich condensation products are well known and include the mono- and di-amino alkanes and their substituted analogs, e.g., ethylamine and diethanol amine; aromatic diamines, e.g., phenylene diamine, diamino naphthalenes; heterocyclic amines, e.g., morpholine, pyrrole, pyrrolidine, imidazole, imidazolidine, and piperidine; melamine and their substituted analogs.

Examples of alkylene polyamide reactants include ethylenediamine, diethylene triamine, triethylene tetraamine, tetraethylene pentaamine, pentaethylene hexamine, hexaethylene heptaamine, heptaethylene octaamine, octaethylene nonaamine, nonaethylene decamine, and decaethylene undecamine and mixture of such amines having nitrogen contents corresponding to the alkylene polyamines, in the formula $H_2N—(Z—NH—)_nH$, mentioned before, Z is a divalent ethylene and n is 1 to 10 of the foregoing formula. Corresponding propylene polyamines such as propylene diamine and di-, tri-, tetra-, penta-propylene tri-, tetra-, penta- and hexaamines are also suitable reactants. The alkylene polyamines are usually obtained by the reaction of ammonia and dihalo alkanes, such as dichloro alkanes. Thus the alkylene polyamines obtained from the reaction of 2 to 11 moles of ammonia with 1 to 10 moles of dichloroalkanes having 2 to 6 carbon atoms and the chlorines on different carbons are suitable alkylene polyamine reactants.

Aldehyde reactants useful in the preparation of the high molecular products useful in this invention include the aliphatic aldehydes such as formaldehyde (also as paraformaldehyde and formalin), acetaldehyde and aldol (β-hydroxybutyraldehyde). Formaldehyde or a formaldehyde-yielding reactant is preferred.

Hydrocarbyl substituted amine ashless dispersant additives are well known to one skilled in the art; see, for example, U.S. Pat. Nos. 3,275,554; 3,438,757; 3,565,804; 3,755,433, 3,822,209, and 5,084,197.

Preferred dispersants include borated and non-borated succinimides, including those derivatives from mono-succinimides, bis-succinimides, and/or mixtures from mono- and bis-succinimides, wherein the hydrocarbyl succinimide is derived from a hydrocarbylene group such as polyisobutylene having a Mn of from about 500 to about 5000 or a mixture of such hydrocarbylene groups. Other preferred dispersants include succinic acid-esters and amides, alkylphenol-polyamine-coupled Mannich adducts, their capped derivatives, and other related components. Such additives may be used in an amount of about 0.1 to 20 wt %, preferably about 0.1 to 8 wt %.

Pour Point Depressants

Conventional pour point depressants (also known as lube oil flow improvers) may be added to the compositions of the present invention if desired. These pour point depressant may be added to lubricating compositions of the present invention to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655, 479; 2,666,746; 2,721,877; 2.721,878; and 3,250,715 describe useful pour point depressants and/or the preparation thereof. Such additives may be used in an amount of about 0.01 to 5 wt %, preferably about 0.01 to 1.5 wt %.

Corrosion Inhibitors

Corrosion inhibitors are used to reduce the degradation of metallic parts that are in contact with the lubricating oil composition. Suitable corrosion inhibitors include thiadiazoles. See, for example, U.S. Pat. Nos. 2,719,125; 2,719,126; and 3,087,932. Such additives may be used in an amount of about 0.01 to 5 wt %, preferably about 0.01 to 1.5 wt %.

Seal Compatibility Additives

Seal compatibility agents help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), and polybutenyl succinic anhydride. Such additives may be used in an amount of about 0.01 to 3 wt %, preferably about 0.01 to 2 wt %.

Anti-Foam Agents

Anti-foam agents may advantageously be added to lubricant compositions. These agents retard the formation of stable foams. Silicones and organic polymers are typical anti-foam agents. For example, polysiloxanes, such as silicon oil or polydimethyl siloxane, provide antifoam properties. Anti-foam agents are commercially available and may be used in conventional minor amounts along with other additives such as demulsifiers; usually the amount of these additives combined is less than 1 percent and often less than 0.1 percent.

Inhibitors and Antirust Additives

Antirust additives (or corrosion inhibitors) are additives that protect lubricated metal surfaces against chemical attack by water or other contaminants. A wide variety of these are commercially available; they are referred to in Klamann in Lubricants and Related Products, op cit.

One type of antirust additive is a polar compound that wets the metal surface preferentially, protecting it with a film of oil. Another type of antirust additive absorbs water by incorporating it in a water-in-oil emulsion so that only the oil touches the metal surface. Yet another type of antirust additive chemically adheres to the metal to produce a non-reactive surface. Examples of suitable additives include zinc dithiophosphates, metal phenolates, basic metal sulfonates, fatty acids and amines. Such additives may be used in an amount of about 0.01 to 5 wt %, preferably about 0.01 to 1.5 wt %.

Friction Modifiers

A friction modifier is any material or materials that can alter the coefficient of friction of a surface lubricated by any lubricant or fluid containing such material(s). Friction modifiers, also known as friction reducers, or lubricity agents or oiliness agents, and other such agents that change the ability of base oils, formulated lubricant compositions, or functional fluids, to modify the coefficient of friction of a lubricated surface may be effectively used in combination with the base oils or lubricant compositions of the present invention if desired. Friction modifiers that lower the coefficient of friction are particularly advantageous in combination with the base oils and lube compositions of this invention. Friction modifiers may include metal-containing compounds or materials as well as ashless compounds or materials, or mixtures thereof. Metal-containing friction modifiers may include metal salts or metal-ligand complexes where the metals may include alkali, alkaline earth, or transition group metals. Such metal-containing friction modifiers may also have low-ash characteristics. Transition metals may include Mo, Sb, Sn, Fe, Cu, Zn, and others. Ligands may include hydrocarbyl derivative of alcohols, polyols, glycerols, partial ester glycerols, thiols, carboxylates, carbamates, thiocarbamates, dithiocarbamates, phosphates, thiophosphates, dithiophosphates, amides, imides, amines, thiazoles, thiadiazoles, dithiazoles, diazoles, triazoles, and other polar molecular functional groups containing effective amounts of O, N, S, or P, individually or in combination. In particular, Mo-containing compounds can be particularly effective such as for example Mo-dithiocarbamates, Mo(DTC), Mo-dithiophosphates, Mo(DTP), Mo-amines, Mo (Am), Mo-alcoholates, Mo-alcohol-amides, etc. See U.S. Pat. Nos. 5,824,627; 6,232,276; 6,153,564; 6,143,701; 6,110,878; 5,837,657; 6,010,987; 5,906,968; 6,734,150; 6,730,638; 6,689,725; 6,569,820; WO 99/66013; WO 99/47629; WO 98/26030.

Ashless friction modifiers may also include lubricant materials that contain effective amounts of polar groups, for example, hydroxyl-containing hydrocarbyl base oils, glycerides, partial glycerides, glyceride derivatives, and the like. Polar groups in friction modifiers may include hydrocarbyl groups containing effective amounts of O, N, S, or P, individually or in combination. Other friction modifiers that may be particularly effective include, for example, salts (both ash-containing and ashless derivatives) of fatty acids, fatty alcohols, fatty amides, fatty esters, hydroxyl-containing carboxylates, and comparable synthetic long-chain hydrocarbyl acids, alcohols, amides, esters, hydroxy carboxylates, and the like. In some instances fatty organic acids, fatty amines, and sulfurized fatty acids may be used as suitable friction modifiers.

Useful concentrations of friction modifiers may range from about 0.01 wt % to 10-15 wt % or more, often with a preferred range of about 0.1 wt % to 5 wt %. Concentrations of molybdenum-containing materials are often described in terms of Mo metal concentration. Advantageous concentrations of Mo may range from about 10 ppm to 3000 ppm or more, and often with a preferred range of about 20-2000 ppm, and in some instances a more preferred range of about 30-1000 ppm. Friction modifiers of all types may be used alone or in mixtures with the materials of this invention. Often mixtures of two or more friction modifiers, or mixtures of friction modifier(s) with alternate surface active material(s), are also desirable.

Typical Additive Amounts

When lubricating oil compositions contain one or more of the additives discussed above, the additive(s) are blended into the composition in an amount sufficient for it to perform its intended function. Typical amounts of such additives useful in the present invention are shown in Table 1 below.

Note that many of the additives are shipped from the manufacturer and used with a certain amount of base oil solvent in the formulation. Accordingly, the weight amounts in Table 1 below, as well as other amounts mentioned in this patent, are directed to the amount of active ingredient (that is the non-solvent portion of the ingredient). The wt % indicated below are based on the total weight of the lubricating oil composition.

TABLE 1

Typical Amounts of Various Lubricant Oil Components

| Compound | Approximate Wt % (Useful) | Approximate Wt % (Preferred) |
|---|---|---|
| Detergent | 0.01-6 | 0.01-4 |
| Dispersant | 0.1-20 | 0.1-8 |
| Friction Reducer | 0.01-5 | 0.01-1.5 |
| Viscosity Index Improver | 0.0-40 | 0.01-30, more preferably 0.01-15 |

TABLE 1-continued

| Typical Amounts of Various Lubricant Oil Components | | |
|---|---|---|
| Compound | Approximate Wt % (Useful) | Approximate Wt % (Preferred) |
| Supplementary Antioxidant | 0.0-5 | 0.0-1.5 |
| Corrosion Inhibitor | 0.01-5 | 0.01-1.5 |
| Anti-wear Additive | 0.01-6 | 0.01-4 |
| Pour Point Depressant | 0.0-5 | 0.01-1.5 |
| Anti-foam Agent | 0.001-3 | 0.001-0.15 |
| Base Oil | Balance | Balance |

The following non-limiting examples are provided to illustrate the invention.

EXAMPLES 1-3

In the examples, 1 through 3, a series of oils were formulated using a synthetic oil having a kinematic viscosity of 4 cSt at 100° C. and typical additive components as are shown in Table 1, except that the antioxidant additives used were those of the present invention.

The formulations were evaluated in a Thermo Oxidation Engine Oil Simulation Test (TEOST), as provided for by ASTM D7097, also referred to as TEOST [MHT4], herein incorporated by reference, to determine the mass of deposit formed under oxidative conditions. The results of the test are given in Table 2. The concentrations of the antioxidant compounds used are given in ppm by weight based on the total amount of lubricant base oil. As can be seen in Comparative Example 3, when a substituted diaryl o-phenylenediamine compound was used in combination with an ashless hindered phenol, but without a polymetal organometallic compound, the weight of the deposit was 26.3 mg. When 100 ppm of the polymetal organometallic compound was added, the weight of the deposit significantly dropped to 7.4 mg. Even when the amount of the polymetal organometallic compound used was halved to 50 ppm, the weight of the deposit remained low at 5.4 mg evidencing the synergistic effect of the combination of all three components.

A: Polymetal organometallic compound $[MnIV(salpn)(\mu\text{-}O)]_2$, obtained from the University of Michigan, Ann Arbor.

B: Substituted diaryl o-phenylenediamine compound [1,2-benzenediamine, N,N'-bis(2,6dimethyl phenyl)], obtained from Colorado School of Mines.

C: Hindered phenol [4,4-methylene bis(2,6-di-t-butylphenol)], commercially available from Albemarle.

The columns designated A, B and C in the following Tables refer to compounds A, B and C previously defined.

TABLE 2

| | A (ppm) | B (ppm) | C (ppm) | TEOST [MHT-4] Deposit, (mg) |
|---|---|---|---|---|
| Example 1 | 100 | 1000 | 1000 | 7.4 |
| Example 2 | 50 | 1000 | 1000 | 5.4 |
| Comparative Example 3 | 0 | 1000 | 1000 | 26.3 |

EXAMPLES 4-8

Decomposition of tert-butyl hydroperoxides (t-BHP) was carried out in a fully formulated synthetic oil having a kinematic viscosity of 4 cSt at 100° C. containing the typical additive components of Table 1, except that the only antioxidant additives used were those of the present invention.

Separate samples were prepared containing a 2 gram aliquot of oil and the concentrations of antioxidants listed in Table 3, respectively, using the same antioxidants, A, B and C, as those used in Examples 1-3. A sample was added to a 250 ml Erlenmeyer flask. To this was added 100 ml of acidified isopropanol (IPA)/toluene solvent (10% vol. glacial acetic acid, 65% vol. IPA and 25% vol. toluene). The mixture was stirred until the oil dissolved. Excess t-BHP in isooctanol was added to the mixture and stirred. To the resulting solution was added 10 ml of sodium iodide in IPA reagent, prepared fresh daily by refluxing 20 g NaI in 100 ml IPA. The resulting mixture was then refluxed to a temperature of about 104-108° C. while stirring for about 10 minutes. The mixture was subsequently cooled and titrated against sodium thiosulfate solution using starch as the indicator. Zero t-BHP remained in solution after the reaction was completed. The procedure was repeated for the concentrations listed in Table 3. Table 3 sets forth the ratio of catalytic antioxidant compounds used to t-BHP consumed.

TABLE 3

| | A (ppm) | B (ppm) | C (ppm) | Mole Compounds: Mole t-BHP |
|---|---|---|---|---|
| Example 4 | 100 | 1000 | 0 | 288 |
| Example 5 | 100 | 0 | 1000 | 314 |
| Example 6 | 100 | 1000 | 1000 | 523 |
| Example 7 | 50 | 1000 | 1000 | 622 |
| Comparative Example 8 | 0 | 1000 | 1000 | 45 |

As can be seen in Table 3, the synergism between the catalytic antioxidants is shown. When a polymetal organometallic compound is used with either a substituted diaryl o-phenylenediamine compound or a hindered phenol compound, the antioxidative effect is unexpected. The synergistic effect is even more pronounced when all three compounds are used in combination as can be seen by Example 6. Even when the concentration of the polymetal organometallic compound is halved to 50 ppm, the antioxidative effect is surprisingly significant resulting in a molar ratio decomposition of catalytic antioxidants:t-BHP of 1:622.

EXAMPLES 9-14

The same procedure used in Examples 1-3 was followed except that the oil used was a Group II mineral oil.

TABLE 4

| | A (ppm) | B (ppm) | C (ppm) | TEOST [MHT-4] Deposit, (mg) |
|---|---|---|---|---|
| Example 9 | 100 | 1000 | 500 | 2.9 |
| Example 10 | 100 | 1000 | 1000 | 4.6 |
| Example 11 | 50 | 500 | 500 | 3.5 |
| Example 12 | 50 | 1000 | 1000 | 4.9 |
| Comparative Example 13 | 0 | 500 | 500 | 109.0 |
| Comparative Example 14 (Fully formulated mineral oil) | | | | 1.4 |

As can be seen in Table 4, the compounds exhibit significant synergy when used in combination resulting in very low deposits in the oil comparable to the commercial antioxidant, as shown in Example 14, yet at lower concentrations. Although not demonstrated, it is believed that using compound A with compound B or compound A with compound C would also result in a synergistic effect albeit not as great as when all three compounds are used in combination.

The fully formulated oil used in Comparative Example 14 contained about 0.75 wt % of a commercially available antioxidant. The catalytic antioxidants of the present invention exhibited comparable results at significantly lower concentrations.

EXAMPLES 15-18

The same procedure used in Examples 4-8 was followed except that the oil used was a Group II mineral oil.

TABLE 5

| | A (ppm) | B (ppm) | C (ppm) | Mole Compounds: Mole t-BHP |
|---|---|---|---|---|
| Example 15 | 100 | 500 | 0 | 214 |
| Example 16 | 100 | 0 | 500 | 243 |
| Example 17 | 100 | 500 | 500 | 361 |
| Comparative Example 18 | 0 | 500 | 500 | 20 |

EXAMPLES 19-22

The same procedure used in Examples 4-8 was followed except that the oil used was a GTL base oil having a kinematic viscosity of 4 cSt at 100° C.

TABLE 6

| | A (ppm) | B (ppm) | C (ppm) | Mole Compounds: Mole t-BHP |
|---|---|---|---|---|
| Example 19 | 100 | 500 | 0 | 302 |
| Example 20 | 100 | 0 | 500 | 311 |
| Example 21 | 100 | 500 | 500 | 486 |
| Comparative Example 22 | 0 | 500 | 500 | 42 |

EXAMPLES 23-25

The same procedure used in Examples 4-8 was followed except that the oil used was a 1:1 mixture of GTL base oil having a kinematic viscosity of 4 cSt at 100° C. and a Group II mineral oil.

TABLE 7

| | A (ppm) | B (ppm) | C (ppm) | Mole Compounds: Mole t-BHP |
|---|---|---|---|---|
| Example 23 | 100 | 500 | 0 | 259 |
| Example 24 | 100 | 0 | 500 | 297 |
| Example 25 | 100 | 500 | 500 | 494 |
| Comparative Example 26 | 0 | 500 | 500 | 43 |

As can be seen in Example 15 through 25, when a polymetal organometallic compound is used with either a substituted diaryl o-phenylenediamine compound or a hindered phenol compound, the antioxidative effect are completely unexpected. When all three compounds are used in combination, the synergistic effect is even more evident as is demonstrated in Examples 17, 21 and 25.

EXAMPLES 27-41

In the following examples, 27 through 41, a series of oils were formulated using as the base oil a Group II mineral, having a kinematic viscosity of 4 cSt at 100° C., and typical additive components as are shown in Table 1, except that the antioxidants used were those of the present invention.

TABLE 8

| | A (ppm) | B (ppm) | C (ppm) | Hours to 100% Viscosity Increase |
|---|---|---|---|---|
| Example 27 | 100 | 500 | 0 | 170 |
| Example 28 | 100 | 1000 | 0 | 175 |
| Example 29 | 100 | 0 | 500 | 160 |
| Example 30 | 100 | 0 | 1000 | 155 |
| Example 31 | 100 | 500 | 500 | 240 |
| Example 32 | 100 | 500 | 1000 | 250 |
| Example 33 | 100 | 1000 | 500 | 237 |
| Example 34 | 100 | 1000 | 1000 | 245 |
| Comparative Example 35 | 0 | 500 | 500 | 160 |
| Comparative Example 36 | 0 | 500 | 1000 | 155 |
| Comparative Example 37 | 0 | 1000 | 500 | 180 |
| Comparative Example 38 | 0 | 1000 | 1000 | 162 |
| Example 39 | 50 | 500 | 500 | 240 |
| Example 40 | 50 | 1000 | 1000 | 233 |
| Comparative Example 41 (Fully formulated mineral oil) | | | | 185 |

Separate oil mixtures were prepared using 100 grams of the formulated mineral oil mixed with the concentrations listed in Table 8. An oil mixture was then mixed with 0.025 grams of iron acetylacetonate and placed in an aluminum block heating bath at 165° C. Air was bubbled through the mixture at 500 L/min. The oil mixture was sampled at 8-16 hour intervals using 2 ml of oil to determine any increase in viscosity. The time in hours given in Table 8 denotes the time at which the viscosity of the oil mixture increased to 100% of its initial value, i.e., the time it took for the viscosity to double. This procedure was followed for all the oil mixtures listed in Table 8.

As is demonstrated by the data in Table 8, using 100 ppm of compound A with either B or C gave an average time to reach a 100% viscosity increase of about 172.5 hours and 157.5 hours, respectively; averaging 165 hours when compound A was paired with either of compound B or C. When compounds B and C were used in combination with 100 ppm of compound A, the average time to reach a 100% viscosity increase significantly improved to 243 hours demonstrating a 32% improvement over pairing either of compounds B or C with compound A alone. The results were equally significant when the amount of compound A was halved as can be seen in Examples 39 and 40.

The fully formulated oil used in Comparative Example 41 contained about 0.75 wt % of a commercially available antioxidant. The catalytic antioxidants of the present invention exhibited comparable results at significantly lower concentrations.

It will thus be seen that the objects set forth above, among those apparent in the preceding description, are efficiently attained and, since certain changes may be made in carrying out the present invention without departing from the spirit and scope of the invention, it is intended that all matter contained in the above description and shown in the accompanying drawing be interpreted as illustrative and not in a limiting sense.

It is also understood that the following claims are intended to cover all of the generic and specific features of the invention herein described and all statements of the scope of the invention, which as a matter of language, might be said to fall therebetween.

What is claimed is:

1. A lubricating oil exhibiting improved resistance to oxidation and deposit/sludge formation comprising a major amount of lubricant base oil and catalytic antioxidants comprising (a) an effective amount of one or more oil soluble dimanganese compounds having the formula $[Mn^{n}(Ligand)]_2$, where n is the oxidation state and Ligand is an organic moiety complexing the manganese; and, effective amounts of (b) one or more substituted N,N'-diaryl-o-phenylenediamine compounds having Formula I

I

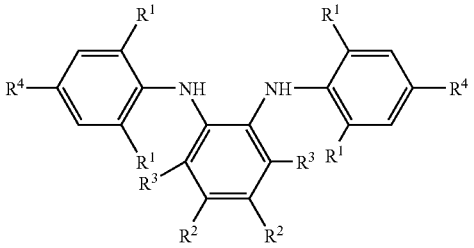

where $R^1$, $R^2$, $R^3$ and $R^4$ are independently H or $C_1$ to $C_{12}$ alkyl; or, (c) one or more hindered phenol compound having Formula II

II

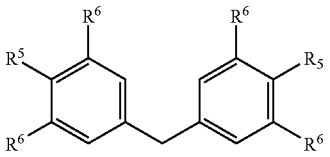

where $R^5$ is OH and $R^6$ is $C_1$ to $C_8$ alkyl;

or a combination of both (b) and (c).

2. A method for improving the resistance of a lubricating oil to oxidation and deposit/sludge formation comprising adding to the lubricating oil catalytic antioxidants comprising (a) an effective amount of one or more oil soluble dimanganese compounds having the formula $[Mn^{n}(Ligand)]_2$, where n is the oxidation state and Ligand is an organic moiety complexing the manganese; and, effective amounts of (b) one or more substituted N,N'-diaryl-o-phenylenediamine compounds having Formula I

I

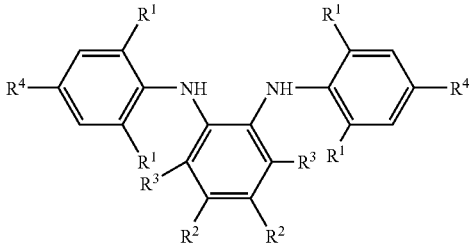

where $R^1$, $R^2$, $R^3$ and $R^4$ are independently H or $C_1$ to $C_{12}$ alkyl; or, (c) one or more hindered phenol compound having Formula II

II

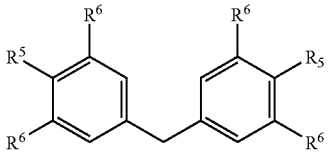

or a combination of both (b) and (c).

3. The lubricating oil of claim 1 wherein the one or more dimanganese compounds is present in an amount in the range of about 1 to 1000 ppm by weight of manganese based on the total amount of the lubricant base oil.

4. The lubricating oil of claim 3 where the one or more dimanganese compounds is present in an amount in the range of about 10 to 500 ppm by weight of manganese based on the total amount of lubricant base oils.

5. The lubricating oil of claim 1 wherein the substituted N,N'-diaryl-o-phenylenediamine compound is present in an amount in the range of about 10 to 5000 ppm based on the total amount of lubricant base oil.

6. The lubricating oil of claim 5 wherein the substituted N,N'-diaryl-o-phenylenediamine compound is present in an amount in the range of about 10 to 1000 ppm based on the total amount of lubricant base oil.

7. The lubricating oil of claim 1 wherein the hindered compound is present in an amount in the range of about 10 to 5000 ppm based on the total amount of lubricant base oil.

8. The lubricating oil of claim 7 wherein the hindered compound is present in an amount in the range of about 100 to 5000 ppm based on the total amount of lubricant base oil.

9. The lubricating oil of claim 1 wherein $R^1$ is methyl, and $R^2$, $R^3$ and $R^4$ are H in Formula I.

10. The lubricating oil of claim 1 wherein $R^5$ is OH and $R^6$ is $C_4$ alkyl in Formula II.

11. The lubricating oil of claim 1 wherein the lubricant base oil is selected from the group consisting of natural oils, petroleum derived mineral oils, synthetic oils, unconventional oils and mixtures thereof.

12. The lubricating oil of claim 1 wherein the lubricant base oil is a GTL base oil, an isomerized wax base oil or mixture thereof.

13. The lubricating oil of claim 12 wherein the GTL base oil is derived from a hydroisomerized Fischer-Tropsch wax.

14. The lubricating oil of claim 1 wherein the Ligand comprises a polydentate Schiff base ligand.

15. The lubricating oil of claim 14 wherein the Schiff base ligand is a N,N'-disalicylidene-1,3-diaminopropane (H2Salpn) ligand or a N,N'-disalicylidene-1,4-diaminobutane (H2Salbn) ligand.

16. An additive concentrate for improving resistance to oxidation and deposit/sludge formation in lubricating oils comprising catalytic antioxidant comprising an effective amount of one or more oil soluble dimanganese compounds having the formula $[Mn''(Ligand)]_2$, where n is the oxidation state and Ligand is an organic moiety complexing the manganese; and, effective amounts of (b) one or more substituted N,N'-diaryl-o-phenylenediamine compounds having Formula I

I

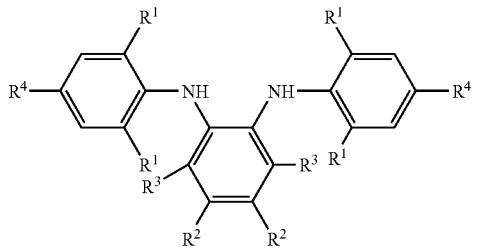

where $R^1$, $R^2$, $R^3$ and $R^4$ are independently H or $C_1$ to $C_{12}$ alkyl; or, (c) one or more hindered phenol compound having Formula II

II

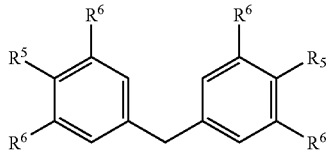

where $R^5$ is OH and $R^6$ is $C_1$ to $C_8$ alkyl;

or a combination of both (b) and (c).

17. Use of the lubricating oil of claim 1 for improving fuel economy in gasoline engine systems.

18. Use of the lubricating oil of claim 1 for improving exhaust emissions in a diesel fuel engine system, wherein the diesel fuel has a sulfur content ranging in the amount of about 5-1,000 ppm.

19. The method of claim 2 wherein the one or more dimanganese compounds is present in an amount in the range of about 1 to 1000 ppm by weight of metal based on the total amount of lubricant base oil.

20. The method of claim 19 wherein the one or more dimanganese compounds is present in an amount in the range of about 10 to 500 ppm by weight of metal based on the total amount of lubricant base oil.

21. The method of claim 2 wherein the substituted N,N'-diaryl-o-phenylenediamine compound is present in an amount in the range of about 10 to 5000 ppm based on the total amount of lubricant base oil.

22. The method of claim 21 wherein the substituted N,N'-diaryl-o-phenylenediamine compound is present in an amount in the range of about 10 to 1000 ppm based on the total amount of lubricant base oil.

23. The method of claim 2 wherein the hindered phenol compound is present in an amount in the range of about 10 to 5000 ppm based on the total amount of lubricant base oil.

24. The method of claim 23 wherein the hindered phenol compound is present in an amount in the range of about 100 to 5000 ppm based on the total amount of lubricant base oil.

25. The method of claim 2 wherein $R^1$ is methyl, and $R^2$, $R^3$ and $R^4$ are H in Formula I.

26. The method of claim 2 wherein $R^5$ is OH and $R^6$ is $C_4$ alkyl in Formula II.

27. The method of claim 2 wherein the lubricant base oil is selected from the group consisting of natural oils, petroleum derived mineral oils, synthetic oils, unconventional oils and mixtures thereof.

28. The method of claim 27 wherein the lubricant base oil is a GTL base oil, an isomerized wax base oil or mixture thereof.

29. The method of claim 2 wherein the polymetal organometallic compound comprises a polydentate Schiff base ligand.

30. The method of claim 29 wherein the Schiff base ligand is a N,N'-disalicylidene-1,3-diaminopropane (H2Salpn) ligand or a N,N'-disalicylidene-1,4-diaminobutane (H2Salbn) ligand.

* * * * *